US005656418A

United States Patent [19]

Nakamine et al.

[11] Patent Number: 5,656,418

[45] Date of Patent: Aug. 12, 1997

[54] SILVER HALIDE COLOR PHOTOGRAPHIC MATERIAL

[75] Inventors: Takeshi Nakamine; Masuji Motoki; Toshio Kawagishi; Naoto Matsuda, all of Ashigara, Japan

[73] Assignee: Fuji Photo Film Co., Ltd., Kanagawa, Japan

[21] Appl. No.: 524,846

[22] Filed: Sep. 7, 1995

[30] Foreign Application Priority Data

Sep. 12, 1994 [JP] Japan ..... 6-242373
Oct. 6, 1994 [JP] Japan ..... 6-266134

[51] Int. Cl.[6] ..... G03C 7/38

[52] U.S. Cl. ..... 430/558

[58] Field of Search ..... 430/558, 955–959

[56] References Cited

U.S. PATENT DOCUMENTS 4,659,652 4/1987 Kawagashi et al. ..... 430/558
4,990,430 2/1991 Harder et al. ..... 430/359

FOREIGN PATENT DOCUMENTS 2-8841 1/1990 Japan ..... G03C 7/38
4-260033 9/1992 Japan ..... G03C 7/38
5-204106 8/1993 Japan ..... G03C 7/38

*Primary Examiner*—Lee C. Wright
*Attorney, Agent, or Firm*—Sughrue, Mion, Zinn, Macpeak & Seas

[57] ABSTRACT

A silver halide color photographic material is described, containing a 1H-pyrazolo[5,1-c]-1,2,4-triazole magenta coupler represented by formula (I) or (II):

(I)

(II)

wherein all variables are defined in the specification, which photographic material exhibits satisfactory magenta color developability to form a dye image having a high density and excellent storage stability.

5 Claims, No Drawings

SILVER HALIDE COLOR PHOTOGRAPHIC MATERIAL

FIELD OF THE INVENTION

This invention relates to a silver halide color photographic material and more particularly to a silver halide color photographic material containing a 1H-pyrazolo[5,1-c]-1,2,4-triazole magenta coupler which exhibits improved color reproducibility, improved color developability, and improved magenta dye stability.

BACKGROUND OF THE INVENTION

Silver halide color photographic materials generally comprise a support having thereon a multilayered light-sensitive layer composed of three kinds of silver halide emulsion layers selectively sensitized so as to have sensitivity to blue light, green light, and red light, in which each light-sensitive layer contains a photographic coupler capable of developing yellow, magenta or cyan. A color image can be obtained by exposing the above-mentioned light-sensitive material followed by color development processing with a color developer. In the color development processing, an aromatic primary amine color developing agent and the photographic coupler are oxidatively coupled to produce an azomethine or indophenol type dye. In order to obtain a color image with satisfactory color reproduction, it is important that the thus developed dye is a clear yellow, magenta or cyan dye with little side adsorption.

While pyrazolone compounds have been used as magenta couplers, dyes formed by the pyrazolone couplers show unfavorable side absorption, and improvement on this aspect has been demanded. In order to solve this problem, pyrazolotriazole couplers with reduced side absorption were proposed in U.S. Pat. Nos. 3,725,065, 3,810,761, 3,758,309, and 3,725,067. However, these improved pyrazolotriazole couplers were still insufficient in terms of color developability. Studies for improvement of color developability had been continued as can be seen from the proposals described in JP-A-60-55343, JP-A-60-98434, JP-A-61-120152, JP-A-4-260033, JP-A-4-289852, and JP-A-5-204106 (the term "JP-A" as used herein means an "unexamined published Japanese patent application"). However, none of the so far proposed compounds did not reach a satisfactory level. In particular, with the recent advances in processing speed, color developability of these compounds has now turned to be insufficient, still demanding further improvement.

Further, azomethine dyes formed by the pyrazolotriazole couplers disclosed in the U.S. patents listed above have low resistance to light, which has significantly impaired the quality of color photographic materials, especially those for printing. Hence, studies were conducted aiming at improvement of light stability as described in JP-B-5-88457, JP-B-6-1358, JP-B-6-8950 (the term "JP-B" as used herein means an "examined published Japanese patent application"), JP-A-5-323530, and JP-A-5-313326. Nevertheless, light stability of the magenta dyes formed by the compounds disclosed in these publications was still insufficient, and further improvement has been demanded.

On the other hand, various efforts have been made to apply pyrazolotriazole couplers to color reversal light-sensitive materials as disclosed in JP-A-5-204106. However, conventional pyrazolotriazole couplers do not exhibit both sufficient color developability and dye image storage stability when used in color reversal light-sensitive materials.

SUMMARY OF THE INVENTION

An object of the present invention is to provide a color photographic material which eliminates the above-described problems.

More specifically, a first object of the present invention is to provide a 1H-pyrazolo[5,1-c]-1,2,4-triazole magenta coupler which exhibits high color developability to such an extent that does not impair graininess (size of dye cloud) and provides a dye having a favorable absorption maximum wavelength.

A second object of the present invention is to provide a color photographic material containing the above magenta coupler which forms an azomethine dye image having improved stability.

A third object of the present invention is to provide a color photographic material having excellent azomethine dye color reproducibility.

The above objects of the present invention are accomplished by a 1H-pyrazolo[5,1-c]-1,2,4-triazole magenta coupler represented by formula (I) or (II):

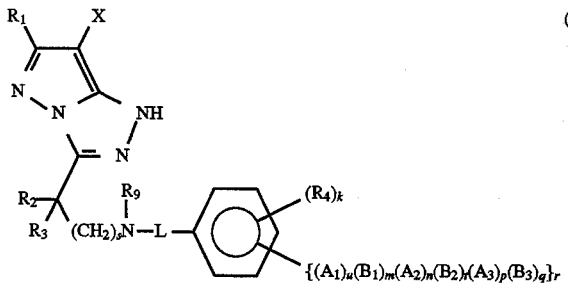

(I)

wherein $R_1$ and $R_4$ each represent a substituent; $R_2$ and $R_3$ each represent a hydrogen atom, an alkyl group, an aryl group, a hydroxyl group or an alkyl group substituted with at least one hydroxyl group; $R_9$ represents a hydrogen atom, an alkyl group, an aryl group, an acyl group or a sulfonyl group; L represents $—SO_2—$, —CO—, $—SO_2NR_{10}—$, $—CONR_{10}—$ or —COO—; $R_{10}$ represents a hydrogen atom, an alkyl group or an aryl group; $A_1$, $A_2$, and $A_3$ each represent —O—, $—NR_5—$, $—NR_5CO—$, $—CONR_5—$, $—NR_5SO_2—$, $—SO_2NR_5—$, —COO—, —OCO—, $—NR_5CONR_5—$, $—OCONR_5—$ or —NHCOO—; $R_5$ represents a hydrogen atom, an alkyl group, an aryl group or an alkyl group substituted with at least one hydroxyl group; $B_1$, $B_2$, and $B_3$ each represent an alkyl group, an alkylene group, an aryl group, an arylene group, an alkyl group substituted with at least one hydroxyl group or an alkylene group substituted with at least one hydroxyl group; s represents 0 or an integer of 1 to 3; X represents a hydrogen atom or a group releasable on coupling with an oxidized aromatic primary amine developing agent; k represents 0 or an integer of 1 to 3; u, m, n, t, and p each represent 0 or 1, provided that m−n+t−p=0; q represents 1; r represents 1 or 2; and at least one of $R_1$, $R_2$, $R_3$, $R_4$, $R_5$, $B_1$, $B_2$, and $B_3$ has a hydroxyl group, provided that the hydroxyl group is not the one directly bonded to an aryl group,

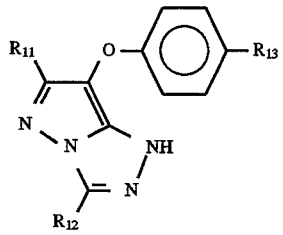

(II)

wherein $R_{11}$ represents an alkyl group, an aryl group, an alkoxy group or an aryloxy group; $R_{12}$ represents a hydrogen atom or a substituent; $R_{13}$ represents $—(W)_f—(Y)_g—Z$; W represents —O—, —NH—, $—CH_2—$ or a divalent linking group composed of two or more thereof; f represents 0 or 1; Y represents —CO— or —$SO_2$—; g represents 0 or 1; Z represents —$R_{14}$, —$OR_{14}$ or —$N(R_{15})_2$; $R_{14}$ represents an alkyl group substituted with a hydroxyl group and/or a carboxyl group; $R_{15}$ represents a hydrogen atom, a hydroxyl group, an acyl group, an arenesulfonyl group, an alkanesulfonyl group, an aryl group or an alkyl group; the two $R_{15}$ groups may be the same or different; $R_{13}$ contains 0 to 8 carbon atoms; the alkyl group represented by $R_{15}$ is a substituted or unsubstituted alkyl group when f=g=1, and in other cases it is a substituted alkyl group.

DETAILED DESCRIPTION OF THE INVENTION

In formula (I), $R_1$ represents an alkyl group (a straight-chain, branched or cyclic alkyl group having 1 to 32 carbon atoms, preferably 1 to 20 carbon atoms (e.g., methyl, ethyl, propyl, isopropyl, butyl, isobutyl, sec-butyl, t-butyl, octyl, t-octyl, decyl, dodecyl, tridecyl, tetradecyl, hexadecyl, octadecyl, neopentyl, 2-ethylhexyl, cyclopropyl, cyclopentyl, cyclohexyl, 1-norbonyl or 1-adamantyl)), an alkenyl group (an alkenyl group preferably having 2 to 32 carbon atoms (e.g., vinyl, allyl, 1-propenyl, 3-buten-1-yl or 3-cyclohexenyl)), an aryl group (an aryl group having 6 to 32 carbon atoms, preferably 6 to 20 carbon atoms (e.g., phenyl, 1-naphthyl or 2-naphthyl)), a heterocyclic group (preferably a 5- to 8-membered heterocyclic group having 1 to 32 carbon atoms (e.g., 2-thienyl, 4-pyridyl, 2-furyl, 2-pyrimidinyl, 1-pyridyl, 2-benzothiazolyl, 1-imidazolyl, 1-pyrazolyl or benzotriazol-2-yl), a cyano group, a halogen atom (e.g., fluorine, chlorine or bromine), a hydroxyl group, a nitro group, an alkoxy group (an alkoxy group having 1 to 32 carbon atoms, preferably 1 to 20 carbon atoms (e.g., methoxy, ethoxy, 1-butoxy, 2-butoxy, isopropoxy, t-butoxy, 2-ethylhexyloxy, dodecyloxy, cyclopentyloxy or cyclohexyloxy)), an aryloxy group (an aryloxy group having 6 to 32 carbon atoms, preferably 6 to 10 carbon atoms (e.g., phenoxy or 2-naphthoxy)), a heterocyclic oxy group (a heterocyclic oxy group preferably having 1 to 32 carbon atoms (e.g., 1-phenyltetrazole-5-oxy, 2-tetrahydropyranyloxy or 2-furyloxy)), a silyloxy group (a silyloxy group preferably having 1 to 32 carbon atoms (e.g., trimethylsilyloxy, t-butyldimethylsilyloxy or diphenylmethylsilyloxy)), an acyloxy group (an acyloxy group preferably having 2 to 32 carbon atoms (e.g., acetoxy, pivaloyloxy, benzoyloxy or dodecanoyloxy)), an alkoxycarbonyloxy group (an alkoxycarbonyloxy group preferably having 2 to 32 carbon atoms (e.g., ethoxycarbonyloxy, t-butoxycarbonyloxy or cyclohexyloxycarbonyloxy)), an aryloxycarbonyloxy group (an aryloxycarbonyloxy group preferably having 7 to 32 carbon atoms (e.g., phenoxycarbonyloxy)), a carbamoyloxy group (a carbamoyloxy group preferably having 1 to 32 carbon atoms (e.g., N,N-dimethylcarbamoyloxy or N-butylcarbamoyloxy)), a sulfamoyloxy group (a sulfamoyloxy group preferably having 1 to 32 carbon atoms (e.g., N,N-diethylsulfamoyloxy or N-propylsulfamoyloxy)), an alkanesulfonyloxy group (an alkanesulfonyloxy group preferably having 1 to 32 carbon atoms (e.g., methanesulfonyloxy or hexadecanesulfonyloxy)), an arenesulfonyloxy group (an arenesulfonyloxy group preferably having 6 to 32 carbon atoms (e.g., benzenesulfonyloxy)), an acyl group (an acyl group preferably having 1 to 32 carbon atoms (e.g., formyl, acetyl, pivaloyl, benzoyl or tetradecanoyl)), an alkoxycarbonyl group (an alkoxycarbonyl group preferably having 2 to 32 carbon atoms (e.g., methoxycarbonyl, ethoxycarbonyl, octadecyloxycarbonyl or cyclohexyloxycarbonyl)), an aryloxycarbonyl group (an aryloxycarbonyl group preferably having 7 to 32 carbon atoms (e.g., pehnoxycarbonyl)), a carbamoyl group (a carbamoyl group preferably having 1 to 32 carbon atoms (e.g., carbamoyl, N,N-dibutylcarbamoyl, N-ethyl-N-octylcarbamoyl or N-propylcarbamoyl)), an amino group (an amino group preferably having not more than 32 carbon atoms (e.g., amino, methylamino, N,N-dioctylamino, tetradecylamino or octadecylamino)), an anilino group (an anilino group preferably having 6 to 32 carbon atoms (e.g., anilino or N-methylanilino)), a heterocyclic amino group (a heterocyclic amino group preferably having 1 to 32 carbon atoms (e.g., 4-pyridylamino)), a carbonamido group (a carbonamido group preferably having 2 to 32 carbon atoms (e.g., acetamido, benzamido or tetradecanamido)), a ureido group (a ureido group preferably having 1 to 32 carbon atoms (e.g., ureido, N,N-dimethylureido or N-phenylureido)), an imido group (an imido group preferably having not more than 10 carbon atoms (e.g., N-succinimido or N-phthalimido)), an alkoxycarbonylamino group (an alkoxycarbonylamino group preferably having 2 to 32 carbon atoms (e.g., methoxycarbonylamino, ethoxycarbonylamino, t-butoxycarbonylamino or octadecyloxycarbonylamino)), an aryloxycarbonylamino group (an aryloxycarbonylamino group preferably having 7 to 32 carbon atoms (e.g., phenoxycarbonylamino)), a sulfonamido group (a sulfonamido group preferably having 1 to 32 carbon atoms (e.g., methanesulfonamido, butanesulfonamido, benzenesulfonamido or hexadecanesulfonamido)), a sulfamoylamino group (a sulfamoylamino group preferably having 1 to 32 carbon atoms (e.g., N,N-dipropylsulfamoylamino or N-ethyl-N-dodecylsulfamoylamino)), an azo group (an azo group preferably having 1 to 32 carbon atoms (e.g., phenylazo)), an alkylthio group (an alkylthio group preferably having 1 to 32 carbon atoms (e.g., ethylthio or octylthio)), an arylthio group (an arylthio group preferably having 6 to 32 carbon atoms (e.g., phenylthio)), a heterocyclic thio group (a heterocyclic thio group preferably having 1 to 32 carbon atoms (e.g., 2-benzothiazolylthio, 2-pyridylthio or 1-phenyltetrazolylthio)), an alkylsulfinyl group (an alkylsulfinyl group preferably having 1 to 32 carbon atoms (e.g., dodecanesulfinyl)), an arenesulfinyl group (an arenesulfinyl group preferably having 6 to 32 carbon atoms (e.g., benzenesulfinyl)), an alkanesulfonyl group (an alkanesulfonyl group preferably having 1 to 32 carbon atoms (e.g., methanesulfonyl or octanesulfonyl)), an arenesulfonyl group (an arenesulfonyl group preferably having 6 to 32 carbon atoms (e.g., benzenesulfonyl or 1-naphthalenesulfonyl)), a sulfamoyl group (a sulfamoyl group preferably having not more than 32 carbon atoms (e.g., sulfamoyl, N,N-dipropylsulfamoyl or N-ethyl-N-dodecylsulfamoyl)), a sulfo group, or a phosphonyl group (a phosphonyl group preferably having 1 to 32 carbon atoms (e.g., phenoxyphosphonyl, octyloxyphosphonyl or phenylphosphonyl)).

The group listed above may be substituted. Suitable substituents include a halogen atom, an alkyl group, an alkenyl group, an aryl group, a heterocyclic group, a cyano group, a hydroxyl group, a carboxyl group, a nitro group, an alkoxy group, an aryloxy group, a heterocyclic oxy group, a silyloxy group, an acyloxy group, an alkoxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, an aryloxycarbonyl group, a carbamoyl group, an amino group, an anilino group, an heterocyclic amino group, a carbonamido group, an alkoxycarbonylamino group, an aryloxycarbonylamino group, a ureido group, a sulfonamido group, a sulfamoyl group, a sulfamoylamino group, an imido group, an alkylthio group, an arylthio group, a heterocyclic thio group, a sulfinyl group, a sulfo group, an alkanesulfonyl group, an arenesulfonyl group, a phosphonyl group, and an azo group. These substituents each have the same meaning as described above.

$R_2$ and $R_3$ each represent a hydrogen atom, an alkyl group (the same as described for $R_1$), an aryl group (the same as described for $R_1$), a hydroxyl group, or an alkyl group substituted with at least one hydroxyl group. The alkyl moiety in the alkyl group substituted with at least one hydroxyl group is a straight-chain or branched alkyl group preferably having 1 to 32 carbon atoms. Examples of the hydroxyalkyl group are hydroxymethyl, dihydroxymethyl, 1-hydroxyethyl, 2-hydroxyethyl, 1,2-dihydroxyethyl, 2-hydroxypropyl, 3-hydroxypropyl, 2,3-dihydroxypropyl, 4-hydroxybutyl, 3,4-dihydroxybutyl, 1,1-dimethyl-2-hydroxyethyl, 1,1-dihydroxymethylethyl, 2-trihydroxymethylethyl and 5-hydroxyamyl groups. $R_2$ and $R_3$ may be connected to each other to form a ring.

$R_4$ represents an alkyl group, an alkenyl group, an aryl group, a heterocyclic group, a cyano group, a halogen atom, a hydroxyl group, a nitro group, an alkoxy group, an aryloxy group, a heterocyclic oxy group, a silyloxy group, an acyloxy group, an alkoxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, an aryloxycarbonyl group, a carbamoyl group, an amino group, an anilino group, a heterocyclic amino group, a carbonamido group, a ureido group, an imido group, an alkoxycarbonylamino group, an aryloxycarbonylamino group, a sulfonamido group, a sulfamoylamino group, an azo group, an alkylthio group, an arylthio group, a heterocyclic thio group, an alkylsulfinyl group, an arenesulfinyl group, an alkanesulfonyl group, an arenesulfonyl group, a sulfamoyl group or a sulfo group. Specific examples of these group are the same as those described above for $R_1$.

The groups listed above for $R_2$, $R_3$, and $R_4$ may be substituted. Examples of suitable substituents are the same as those described above as to the substituents on $R_1$.

$R_9$ represents a hydrogen atom, an alkyl group (having the same meaning as described for $R_1$), an aryl group (having the same meaning as described for $R_1$), an acyl group (having the same meaning as described for $R_1$) or a sulfonyl group (having the same meaning as described for $R_1$). These groups may be substituted. Examples of suitable substituents are the same as those described above as to the substituents on $R_1$.

L represents $—SO_2—$, —CO—, $—SO_2NR_{10}—$, $—CONR_{10}—$ or —COO—, wherein $R_{10}$ represents a hydrogen atom, an alkyl group (having the same meaning as described for $R_1$) or an aryl group (having the same meaning as described for $R_1$). The group as $R_{10}$ may be a substituted group, and examples of suitable substituents therefor are the same as those listed as to the substituents on $R_1$.

$A_1$, $A_2$, and $A_3$ each represent —O—, $—NR_5—$, $—NR_5CO—$, $—CONR_5—$, $—NR_5SO_2—$, $—SO_2NR_5—$, —COO—, —OCO—, $—NR_5CONR_5—$, $—OCONR_5—$ or —NHCOO—, wherein $R_5$ represents a hydrogen atom, an alkyl group (having the same meaning as described for $R_1$), an aryl group (having the same meaning as described for $R_1$) or an alkyl group substituted with at least one hydroxyl group (having the same meaning as described for $R_2$ and $R_3$).

$B_1$, $B_2$, and $B_3$ each represent an alkyl group, an alkylene group, an aryl group, an arylene group, an alkyl group substituted with at least one hydroxyl group or an alkylene group substituted with at least one hydroxyl group. The alkyl group and aryl group have the same meanings as described for $R_1$. The arylene group is represented by formula (III):

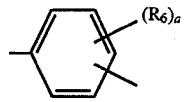

wherein $R_6$ represents a substituent having the same meaning as described as to the substituent on $R_1$; and a represents 0 or an integer of 1 to 4, and contains 6 to 32 carbon atoms. The alkyl group substituted with at least one hydroxyl group has the same meaning as those described above for $R_2$ and $R_3$. The alkylene group or the alkylene group substituted with at least one hydroxyl group is represented by formula (IV):

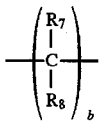

wherein $R_7$ and $R_8$ each represent a hydrogen atom, an alkyl group, an aryl group, a hydroxyl group or an alkyl group substituted with at least one hydroxyl group, each having the same meaning as defined for $R_2$ and $R_3$; and b represents 0 or an integer 1 to 4, and contains 1 to 32 carbon atoms.

X represents a hydrogen atom or a group releasable on coupling with an oxidized developing agent. The releasable group includes a halogen atom, an alkoxy group, an aryloxy group, an acyloxy group, a carbamoyloxy group, a sulfonyloxy group, a carbonamido group, a sulfonamido group, a carbamoylamino group, a heterocyclic group, an arylazo group, an alkylthio group, an arylthio group, and a heterocyclic thio group. A preferred carbon number range and specific examples for each of these groups are the same as those described for $R_1$. Where X is a releasable group except a halogen atom, it may have a substituent, and suitable substituents are the same as those listed as to the substituent on $R_1$. In addition, X includes such groups as forms a bis type coupler in which two molecules of a 4-equivalent coupler are linked together via an aldehyde or ketone group. Further, X includes photographically useful groups serving as a development accelerator, a development restrainer, a desilvering accelerator, a leuco dye, etc., which may be blocked at the active site thereof.

A preferred range of the compound represented by formula (I) is described below.

$R_1$ preferably represents an alkyl group, an aryl group, an alkoxy group, an aryloxy group, an alkylthio group, an arylthio group, a ureido group, an oxycarbonylamino group or an amido group. A primary or secondary alkyl group, an alkoxy group or an aryloxy group is still preferred for high color developability. A tertiary alkyl group or an aryloxy group is still preferred for dye image stability against light and heat. Specific examples of preferred groups represented by $R_1$ are shown below.

$CH_3-$, $C_2H_5-$, $(CH_3)_2CH-$, $(CH_3)_3C-$, $(CH_3)_3CCH_2-$, $C_2H_5C(CH_3)_2-$,

-continued $CH_3O-$, $C_2H_5O-$, $-OCH_2CH_2O-$, $-OCH_2CH(CH_3)O-$, $(t)C_5H_{11}-$ $-OCH_2CH_2O-$, $(CH_3)_3CCH_2O-$, $C_5H_{11}O-$, $-O-$, $CH_3O-$ $-O-$, $(CH_3)_3CCH_2CH(CH_3)CH_2$ $(CH_3)_3CCH_2CH(CH_3)CH-$, $C_{16}H_{33}O-$ $-O-$, $C_{13}H_{27}C(=O)-NH-$ $-O-$ $R_2$ and $R_3$ each preferably represent a hydrogen atom, an alkyl group, an aryl group or an alkyl group substituted with at least one hydroxyl group. Specific examples of preferred groups represented by $R_2$ or $R_3$ are methyl, ethyl, propyl, isopropyl, butyl, t-butyl, octyl, dodecyl, benzyl, cyclohexyl, phenyl, hydroxymethyl and 2-hydroxyethyl groups.

s preferably represents 0 or 1.

$R_4$ preferably represents a halogen atom, an alkyl group, an aryl group, an alkoxy group, an aryloxy group, an alkoxycarbonyl group, an aryloxycarbonyl group, a carbamoyl group, an amino group, a carbonamido group, a sulfonamido group, an alkylthio group or an arylthio group.

k preferably represents 0, 1 or 2, still preferably 1.

X preferably represents a halogen atom, an aryloxy group, a carbamoyloxy group, an acylamino group, a heterocyclic group, an arylazo group, an alkylthio group, an arylthio group or a heterocyclic thio group. A halogen atom, an aryloxy group, a heterocyclic group, an alkylthio group, an arylthio group or heterocyclic thio group is still preferred. A halogen atom or an aryloxy group is particularly preferred. Specific examples of preferred groups represented by X are shown below.

$-O-$ $-CO_2CH_3$, $-O-$ $-C(CH_3)_2CH_2C_4H_9(t)$,

-continued
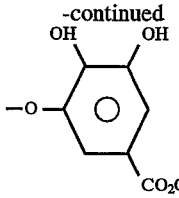
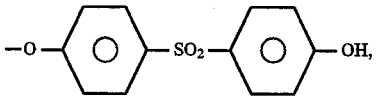
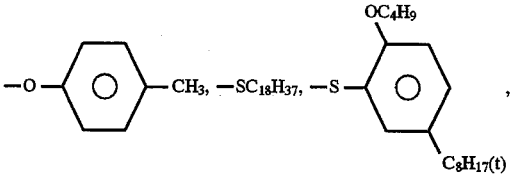
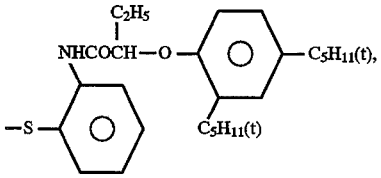
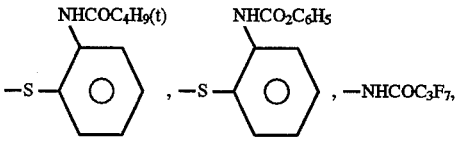
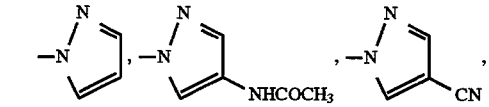
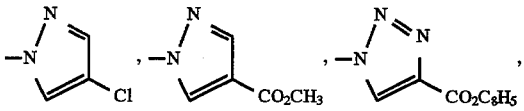
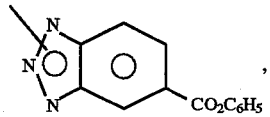
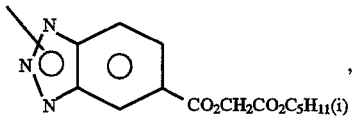
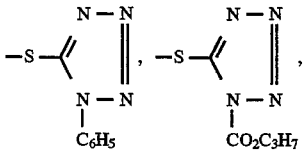
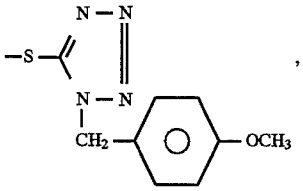
-continued
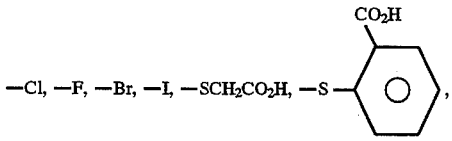
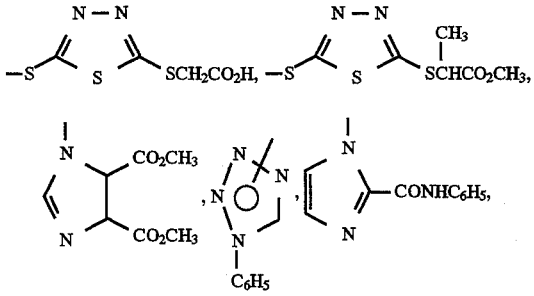
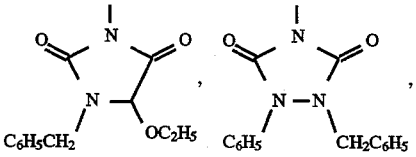
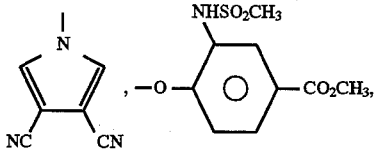
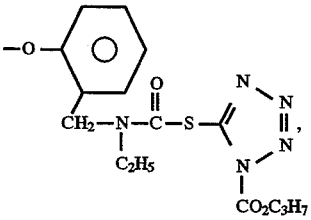
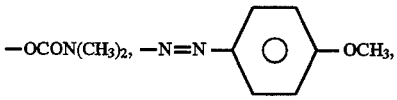
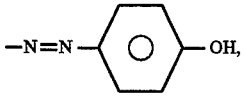
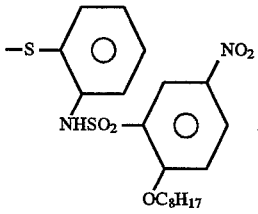
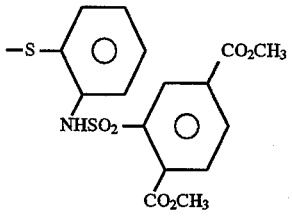

$A_1$, $A_2$, and $A_3$ each preferably represent —O—, —$NR_5$—, —$NR_5CO$—, —$CONR_5$—, —$NR_5SO_2$—, —$SO_2NR_5$—, —COO—, —$NR_5CONR_5$— or —NHCOO—, wherein $R_5$ preferably represents a hydrogen atom, an alkyl group or an alkyl group substituted with a hydroxyl group. Specific examples of preferred groups represented by $R_5$ are the same as those described as preferred examples of $R_2$ and $R_3$.

Of the groups represented by $B_1$, $B_2$, and $B_3$, the alkyl group, aryl group, and alkyl group substituted with at least one hydroxyl group preferably include methyl, ethyl, propyl, isopropyl, butyl, t-butyl, octyl, dodecyl, cyclohexyl, phenyl, hydroxymethyl, 2-hydroxyethyl, 3-hydroxypropyl, 2,3-dihydroxypropyl, 4-hydroxybutyl, 3,4-dihydroxybutyl and 1,1-dihydroxymethylethyl groups. Preferred examples of the arylene group are shown below.

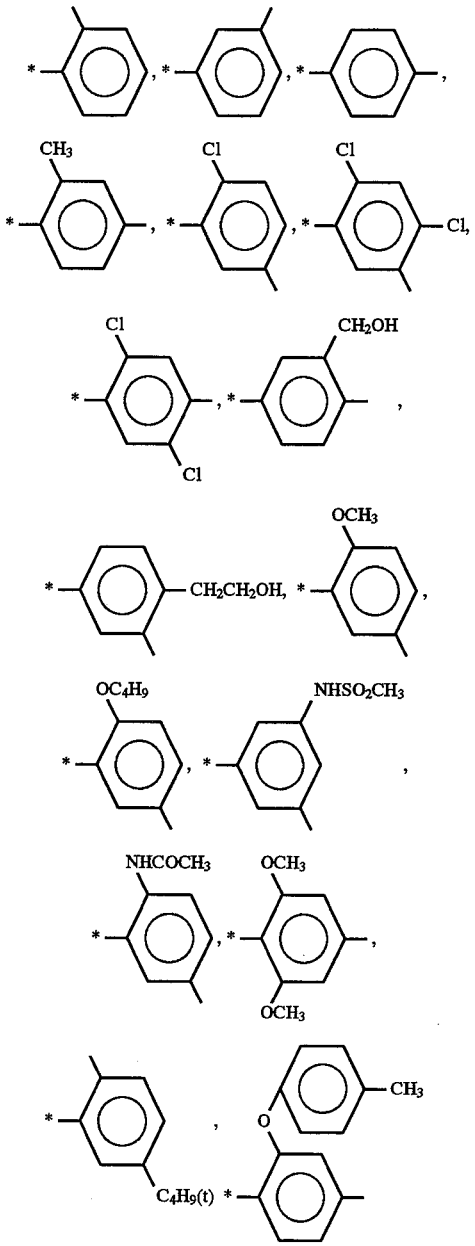

wherein * indicates the position closer to the pyrazolotriazole nucleus.

Specific examples of preferred alkylene groups and preferred hydroxyalkylene groups are shown below.

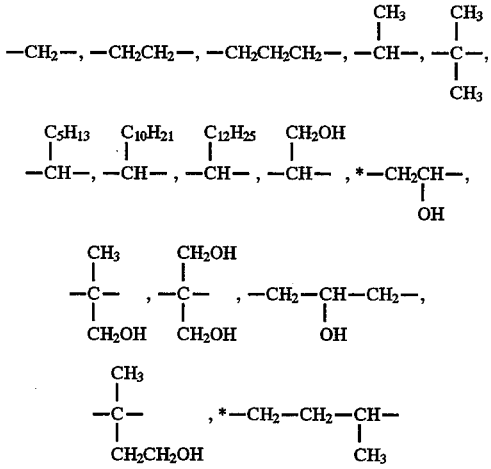

wherein * indicates the position closer to the pyrazolotriazole nucleus.

A preferred combination of the numbers of the substituents $A_1$, $A_2$, $A_3$, $B_1$, $B_2$, and $B_3$ is such that u, m, n, and q are each 1 with t and p being each 0, or that u and q are each 1, and m, n, t, and p are each 0.

The position of the hydroxyalkyl group in the compound of formula (i) is preferably in $B_1$, $B_2$ and $B_3$, still preferably in $B_3$.

The compound of formula (I) is preferably of nondiffusion type, in which a nondiffusing group is preferably present in $R_1$, $R_2$, $R_3$, $R_4$, $B_1$, $B_2$, or $B_3$.

Preferred combinations of the substituents in the compound of formula (I) are described below. When $R_1$ is an alkyl, alkoxy or aryloxy group, it is preferable that $R_2$ and $R_3$ each represent a hydrogen atom, an alkyl group, an aryl group or an alkyl group substituted with at least one hydroxyl group, $R_9$ represents a hydrogen atom or an alkyl group, L represents a sulfonyl group or a carbonyl group, and X represents a halogen atom, an aryloxy group or a heterocyclic group.

The most preferred combination of the substituents in the compound of formula (I) is that $R_1$ is an alkyl group (preferably, methyl, ethyl, isopropyl or t-butyl), $R_2$ and $R_3$ are each a hydrogen atom or an alkyl group (preferably methyl, ethyl or isopropyl); $R_9$ is a hydrogen atom or an alkyl group (preferably methyl or ethyl); L is a sulfonyl group; X is a chlorine atom or an aryloxy group (preferably p-methoxycarbonylphenyloxy or p-methylphenyloxy); s is 0 or 1; u, m, n, and q are each 1 with t and p being each 0, or u and q are each 1 with m, n, t, and p being each 0; r is 1; and a hydroxyalkyl group is present in $B_1$, $B_2$, and $B_3$.

Specific examples of the pyrazolotriazole magenta couplers represented by formula (I) are shown below for illustrative purpose but not for limitation.

(M-1)
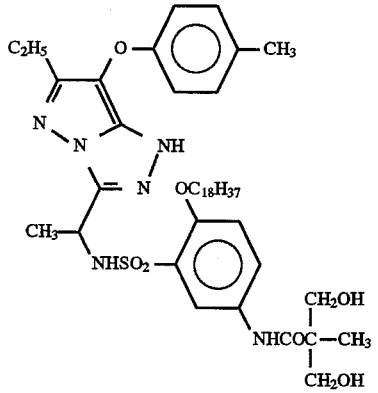
(M-2)
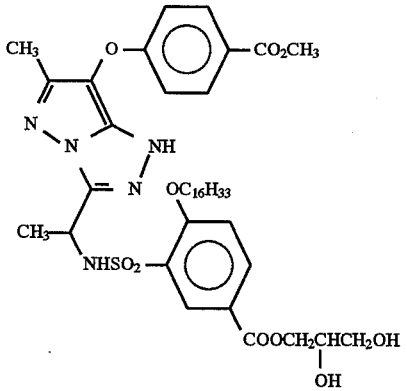
(M-3)
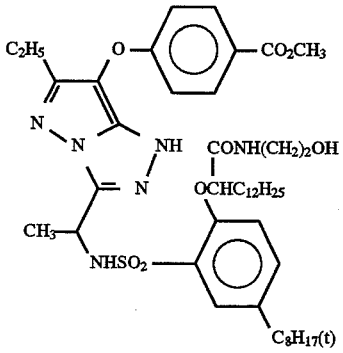
(M-4)
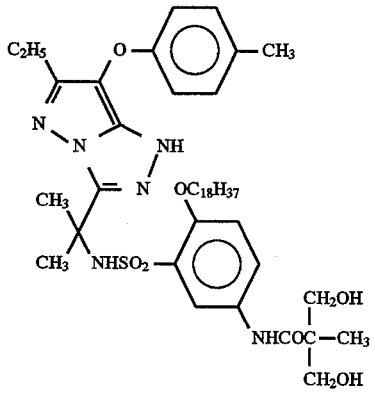
(M-5)
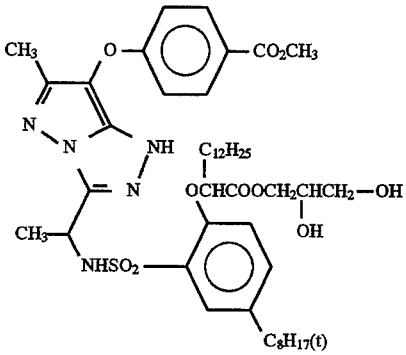
(M-6)
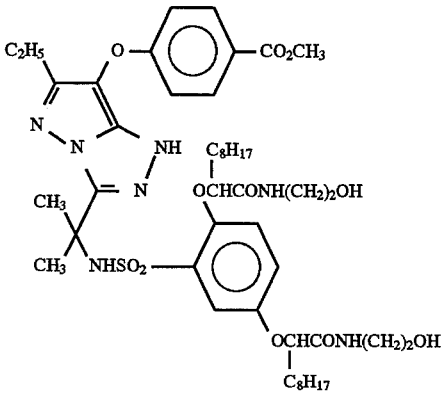
(M-7)
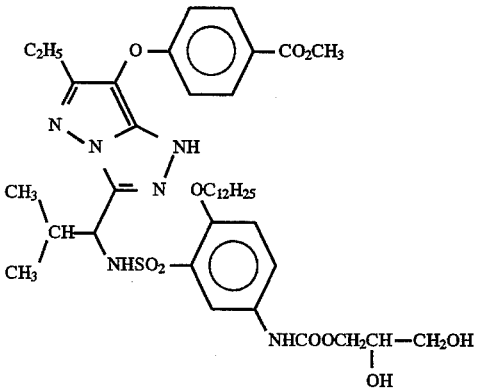
(M-8)
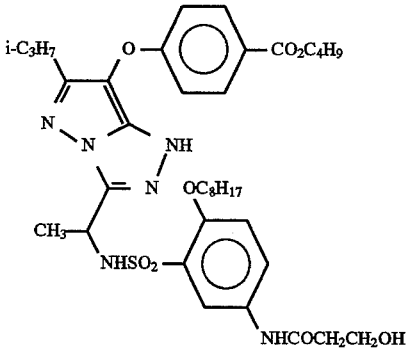

-continued
(M-9)
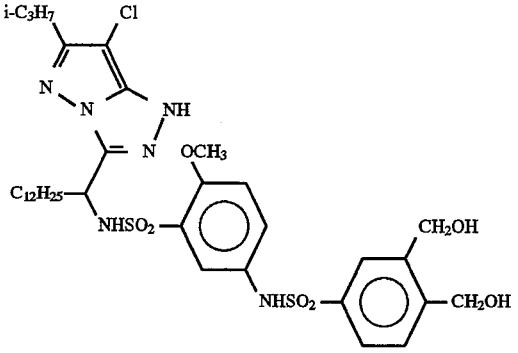
(M-10)
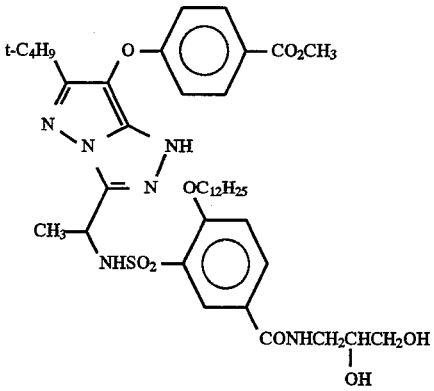
(M-11)
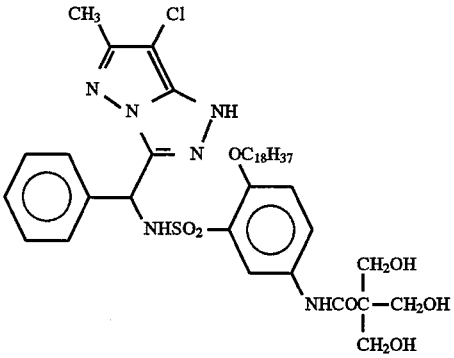
(M-12)
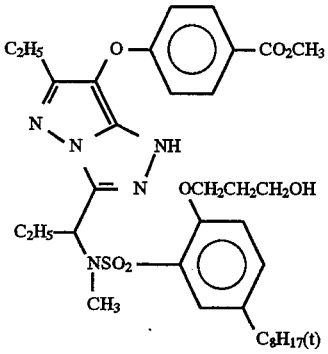
(M-13)
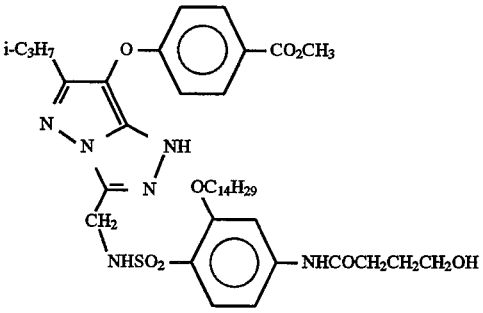
(M-14)
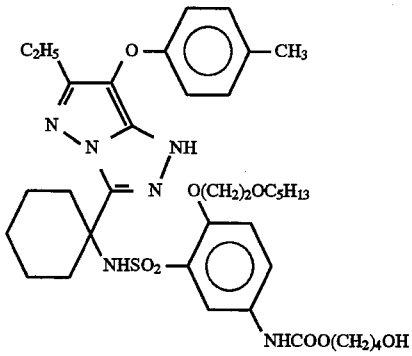
(M-15)
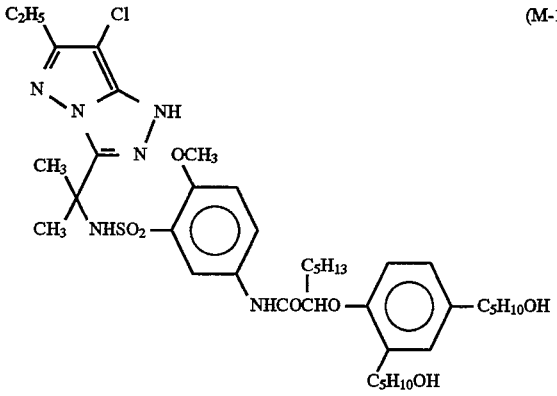
(M-16)
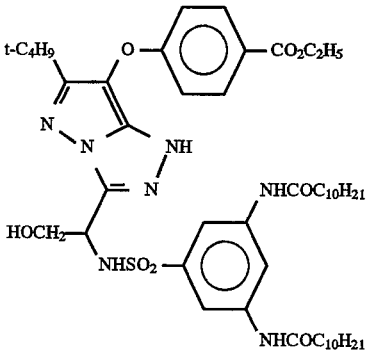

-continued
(M-17)
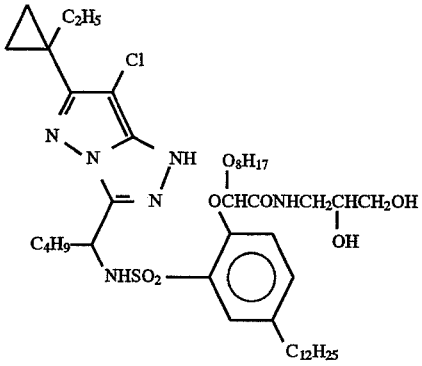
(M-18)
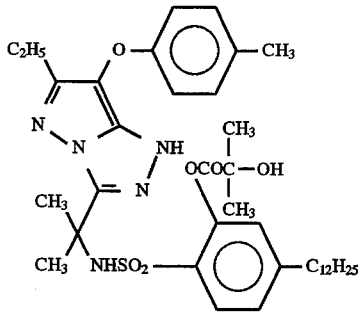
(M-19)
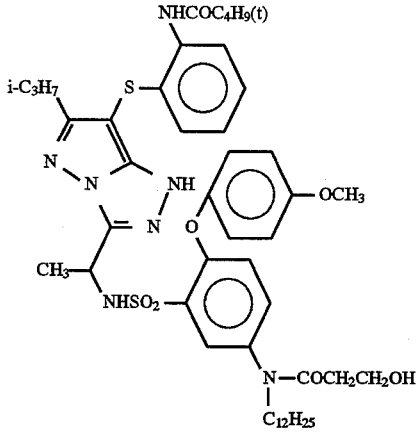
(M-20)
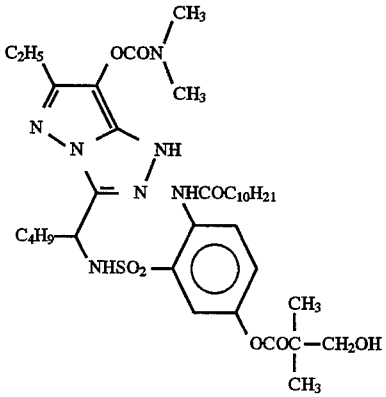
(M-21)
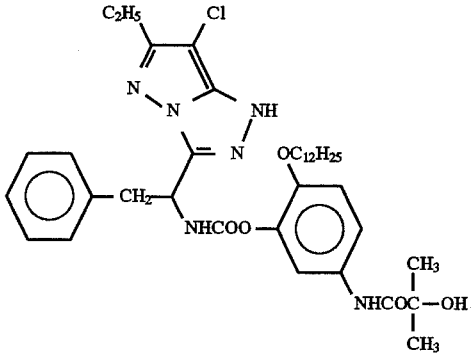
(M-22)
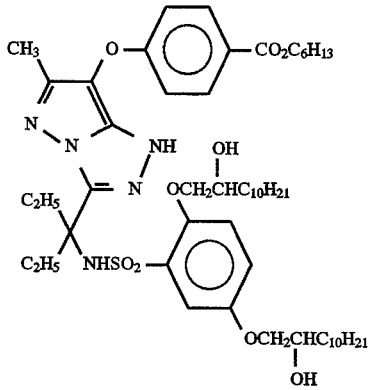
(M-23)
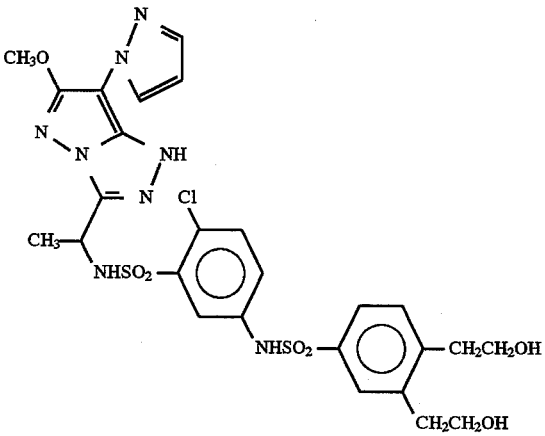

-continued
(M-24)
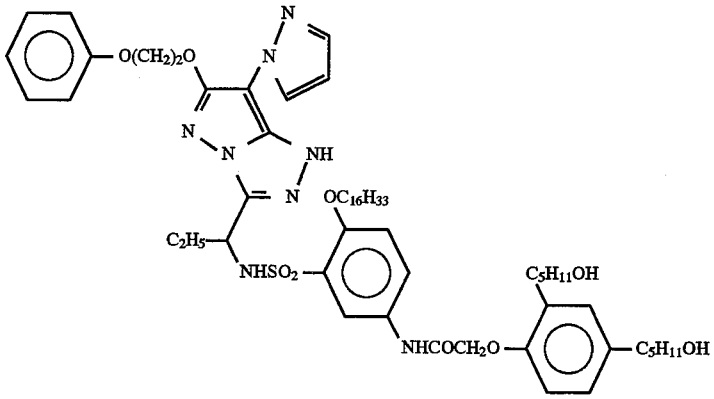
(M-25)
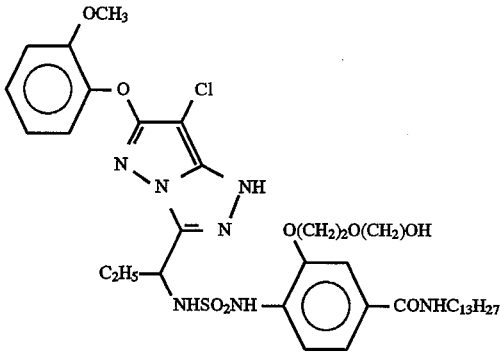
(M-26)
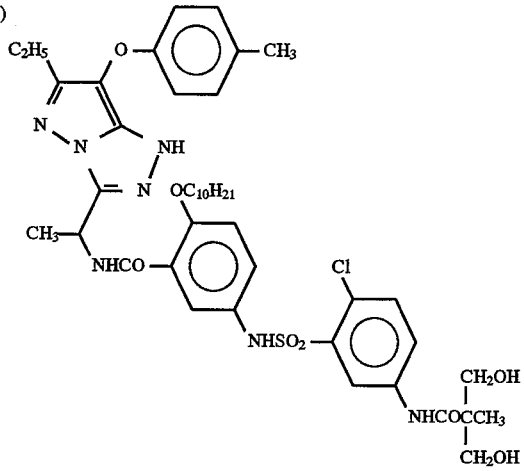
(M-27)
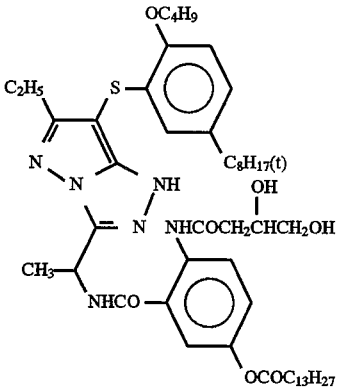
(M-28)
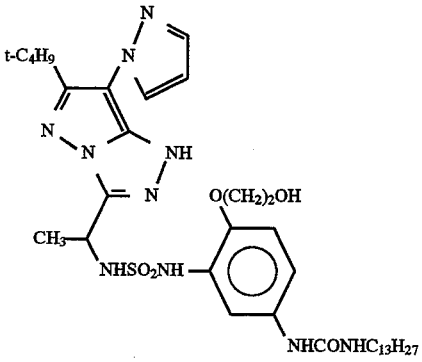
(M-29)
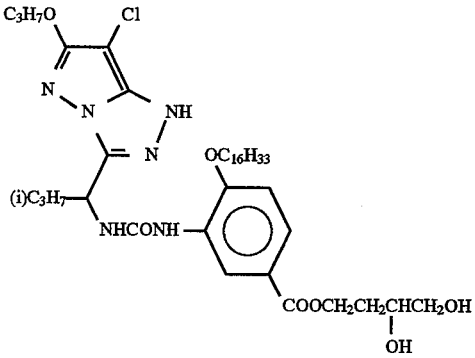
(M-30)
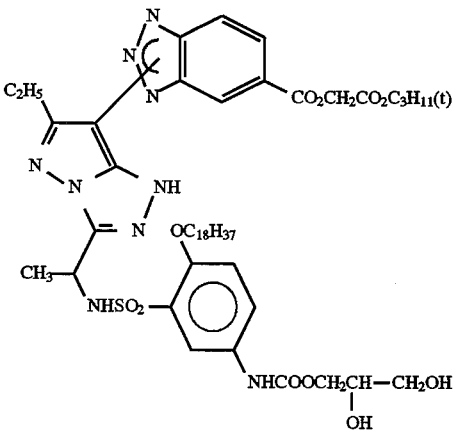

-continued
(M-31)
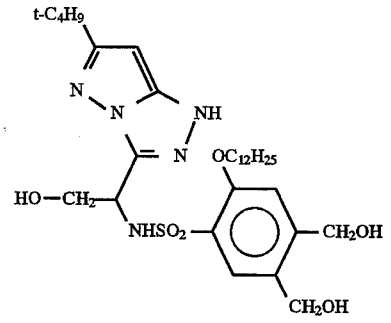
(M-32)
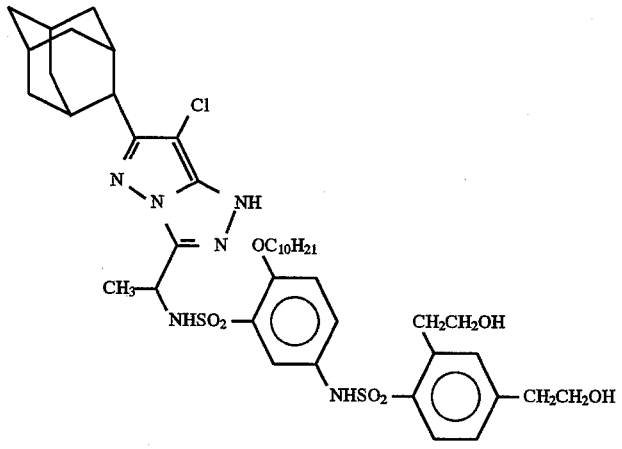
(M-33)
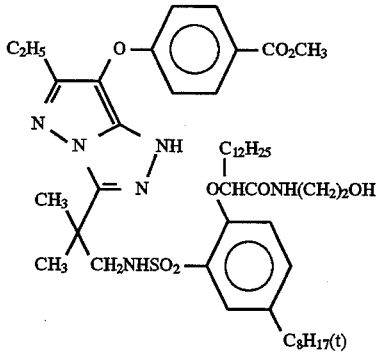
(M-34)
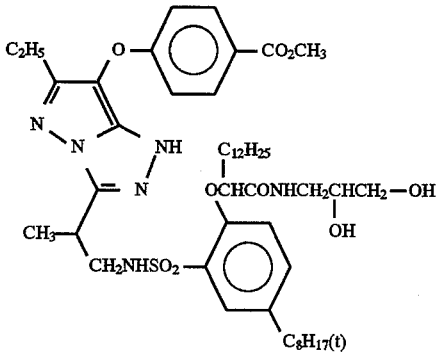
(M-35)
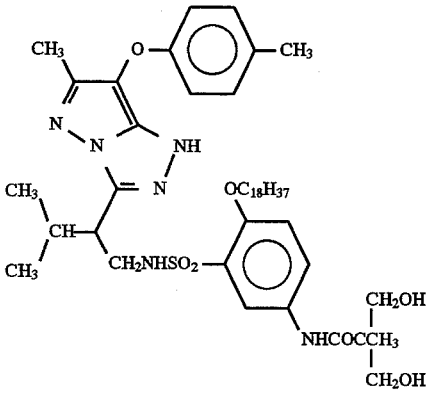
(M-36)
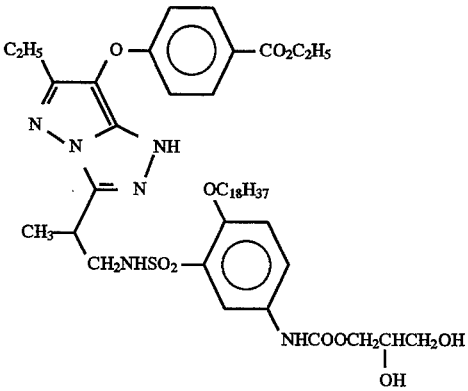

-continued
(M-37)
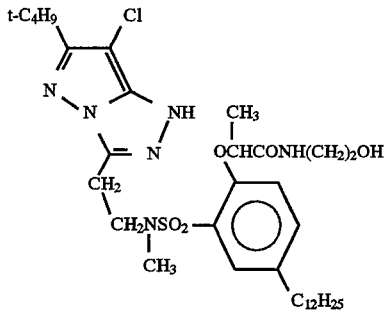
(M-38)
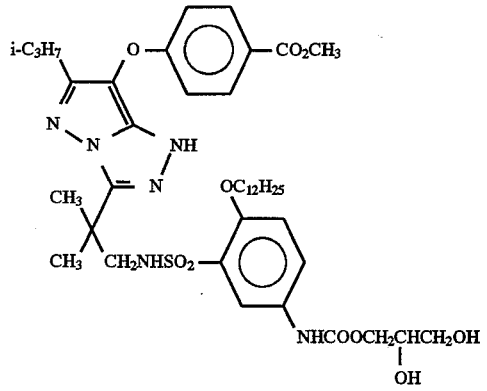
(M-39)
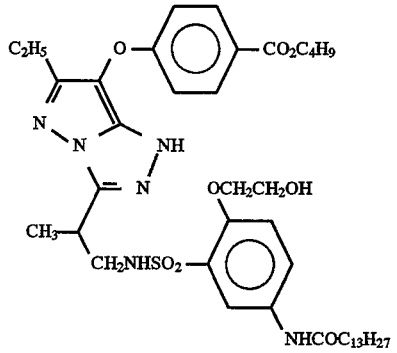
(M-40)
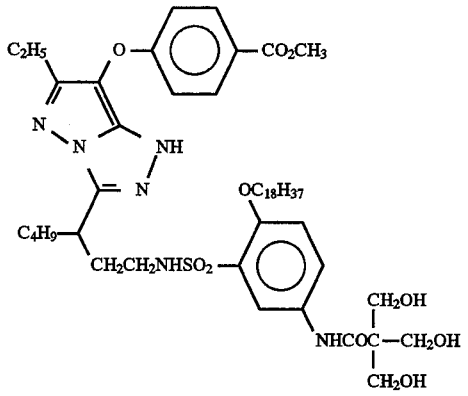
(M-41)
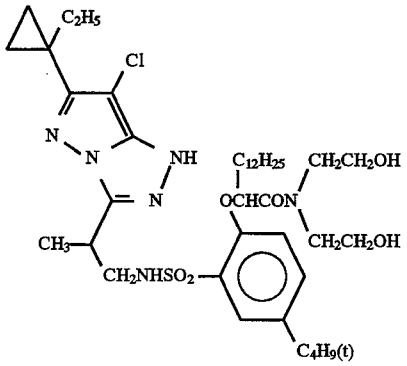
(M-42)
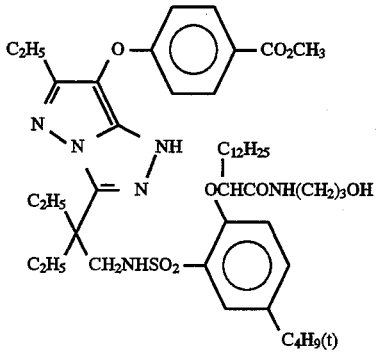
(M-43)
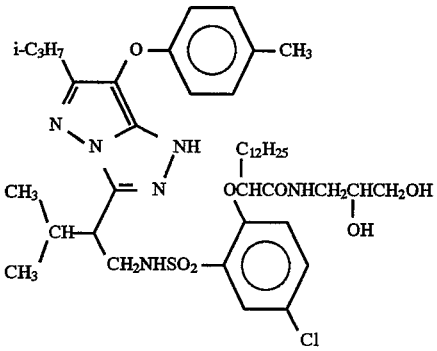
(M-44)
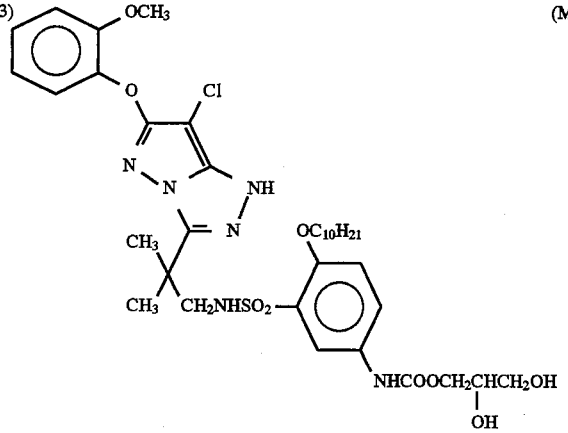

-continued (M-45)

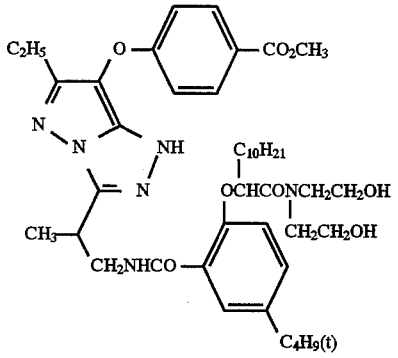

(M-46)

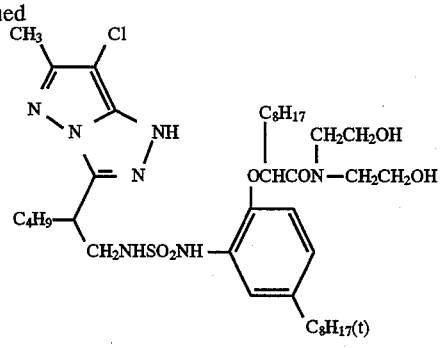

(M-47)

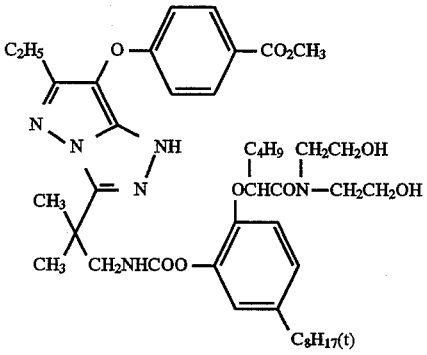

(M-48)

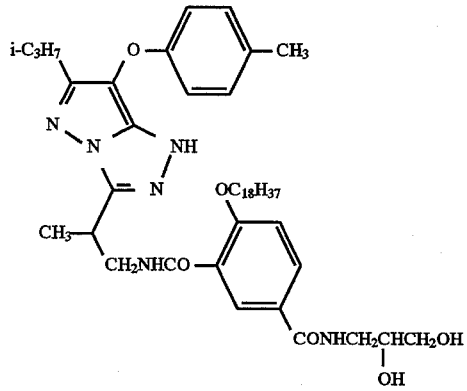

In formula (II), $R_{11}$ represents an alkyl group, an aryl group, an alkoxy group or an aryloxy group, each of which has the same meaning as those described above for $R_1$. $R_{11}$ may be substituted, and the substituents are the same as those which may be on $R_1$. A primary or secondary alkyl group, an alkoxy group or an aryloxy group is preferred for high color developability, while a tertiary alkyl group or an aryloxy group is preferred for dye image stability against light and heat. Specific examples of preferred groups represented by $R_{11}$ are the same as the groups enumerated as preferred $R_1$.

Of the preferred groups as $R_{11}$, a primary, secondary or tertiary alkyl group, e.g., methyl, ethyl, isopropyl, t-butyl or neopentyl group, is particularly preferred taking ease of synthesis as well as capacity into consideration.

$R_{12}$ represents a hydrogen atom or a substituent. Examples of the substituent as $R_{12}$ are the same as those which may be on $R_1$.

$R_{12}$ is preferably a substituted alkyl group or a substituted aryl group, still preferably an alkyl or aryl group substituted with a carbonamido group, a sulfonamido group or a sulfonyl group.

Particularly preferably $R_{12}$ is a group represented by formula (V):

$$—C(R_{16})(R_{17})—(CH_2)_e—NHR_{18} \quad (V)$$

wherein $R_{16}$ and $R_{17}$, which may be the same or different, each represent a hydrogen atom, an alkyl group or an aryl group, or they may be taken together to form a ring; $R_{18}$ represents an alkanesulfonyl group, an arenesulfonyl group or an acyl group; and e represents 0 or an integer 1 to 5.

More specifically, the alkyl group and the aryl group as $R_{16}$ and $R_{17}$ have the same meaning as those described for $R_1$. $R_{16}$ and $R_{17}$ may be substituted with a group which may be on $R_1$. $R_{16}$ and $R_{17}$ may be taken together to form a 3- to 6-membered ring, such as a cyclopropane ring, a cyclopentane ring or a cyclohexane ring.

$R_{16}$ and $R_{17}$ each preferably represent a hydrogen atom, a methyl group, an ethyl group, an isopropyl group, a t-butyl group or a phenyl group.

The alkanesulfonyl, arenesulfonyl and acyl groups as represented by $R_{18}$ have the same meanings as those for the substituents which may be on $R_1$, and each of them may be substituted with the same groups as the substituents which may be on $R_1$. $R_{18}$ is preferably a substituted arenesulfonyl group.

e is 0 or an integer of 1 to 5, preferably 0 or 1.

Specific examples of the group of formula (V), particularly preferred group as $R_{12}$, are shown below.

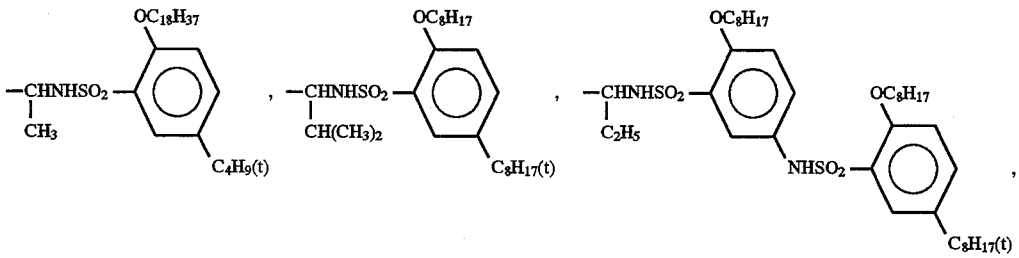

-continued
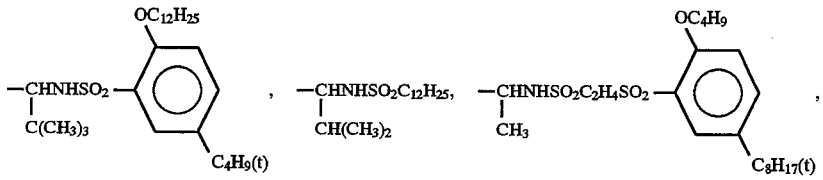
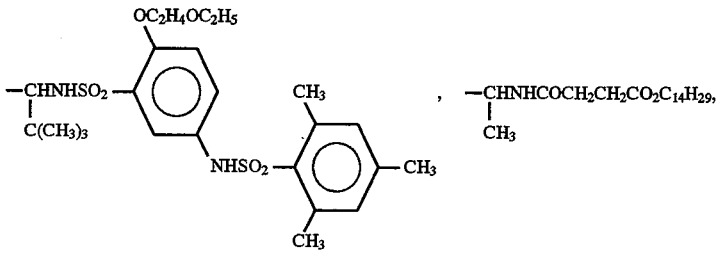
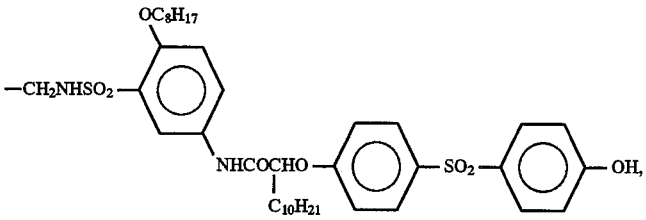
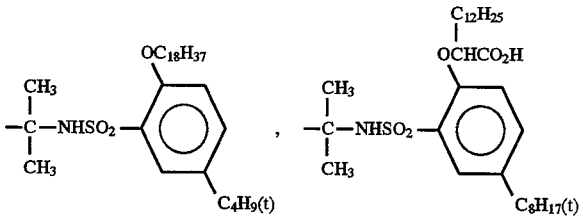
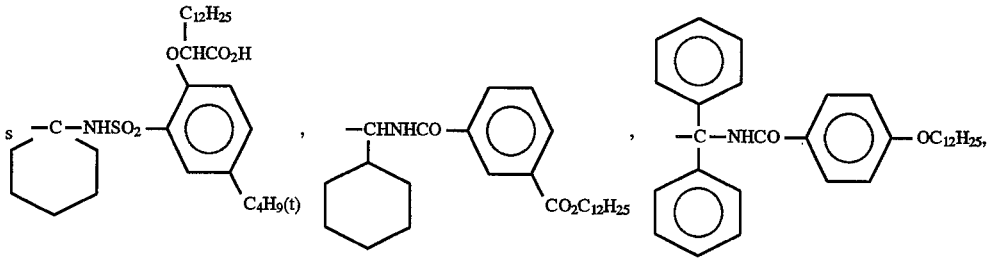
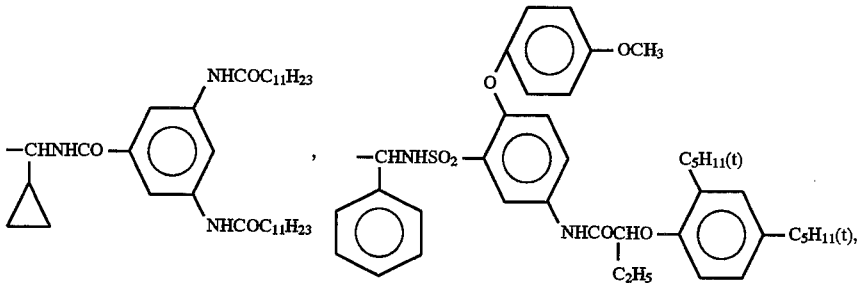
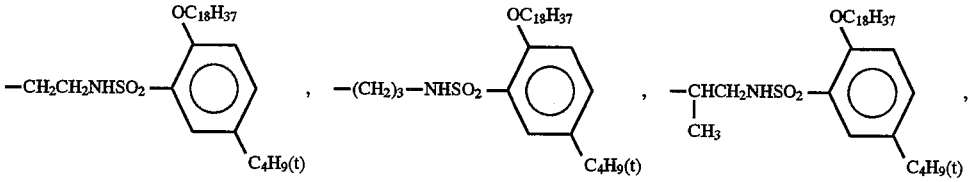

-continued

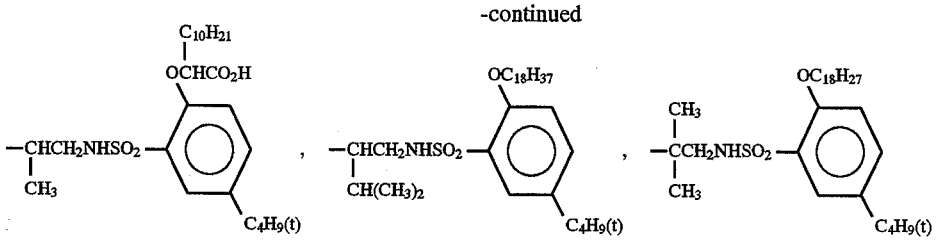

$R_{13}$ represents —$(W)_f$—$(Y)_g$—Z, wherein W represents —O—, —NH—, —$CH_2$— or a divalent linking group composed of two or more thereof (e.g., —$OCH_2$—, —$NHCH_2$—, —$CH_2CH_2$—, —$CH_2O$—, —$CH_2NH$—, —$OCH_2CH_2$—, —$NHCH_2CH_2$—, —$CH_2OCH_2$—, —$CH_2CH_2O$—, —$CH_2CH_2NH$—, —$CH_2NHCH_2$—, —$CH_2CH_2CH_2$—, —$OCH_2CH_2O$—, —$NHCH_2CH_2O$—, —$CH_2CH_2OCH_2$—, —$CH_2OCH_2CH_2$—, and —$CH_2NHCH_2CH_2O$—); f represents 0 or 1; Y represents —CO— or —$SO_2$—; g represents 0 or 1; Z represents —$R_{14}$, —$OR_{14}$ or —$N(R_{15})_2$; $R_{14}$ represents an alkyl group substituted with a hydroxyl group and/or a carboxyl group (e.g., hydroxymethyl, 2-hydroxyethyl, 2,3-dihydroxypropyl or 2-carboxyethyl); $R_{15}$ represents a hydrogen atom, a hydroxyl group, an acyl group (e.g., formyl, acetyl, pivaloyl or benzoyl), an arenesulfonyl group (e.g., benzenesulfonyl), an alkanesulfonyl group (e.g., methanesulfonyl or ethanesulfonyl), an aryl group (e.g., phenyl) or an alkyl group (e.g., methyl, ethyl, propyl or isopropyl). The acyl group, arenesulfonyl group, alkanesulfonyl group or aryl group as $R_{15}$ may be substituted with a group which may be on $R_1$ as far as the condition of the carbon atom number as hereinafter mentioned is satisfied. Where $R_{15}$ is an alkyl group, it may be substituted or unsubstituted when f=g=1, and it is a substituted alkyl group in other cases. The substituent in the substituted alkyl group as $R_{15}$ includes those mentioned above which may be on $R_1$ except an alkyl group and should satisfy the condition of the carbon atom number hereinafter described. The two $R_{15}$ groups may be the same or different. The total carbon atom number of $R_{13}$ is not more than 8, preferably not more than 6, still preferably not more than 4.

Specific examples of preferred groups as $R_{13}$ are shown below.

—$SO_2NH_2$, —$SO_2NHCH_2CH_2OH$, —$SO_2N(CH_2CH_2OH)_2$,

—$SO_2N(CH_2CO_2H)_2$, —$SO_2N(CH_2CONH_2)_2$, —$SO_2NHCOCH_3$,

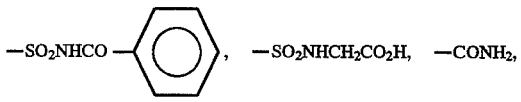

—$SO_2NHCH_2CO_2H$, —$CONH_2$,

—$CONHCH_2CH_2SO_2NH_2$, —$CONHCH_2CH_2OH$,

—$CON(CH_2CH_2OH)_2$, —$CONHCH_2CO_2H$, —$CONH_2CH_2CO_2CH_3$,

-continued

—CONHOH, —CON(CH$_3$)—OH, —CON—OH, —$CON(CH_2CO_2H)_2$,

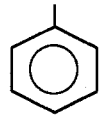

—$CONHCH_2CH_2SO_3H$, —$CONHSO_2CH_3$,

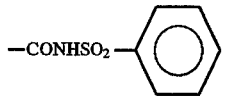

—$CONHCOCH_3$,

—$CONHCH_2CH(OH)CH_2OH$, —$COCH_2CH_2CO_2H$,

—$CO_2CH(CH_2OH)_2$, —$CO_2CH_2CH_2OH$

—$CH_2OCH_2CH_2OH$, —$CH_2OCH_2CH_2CO_2H$,

—$CH_2OCH_2CH_2NHCOCH_3$, —$CH_2CH_2OCONH_2$,

—$CH_2CH_2OCH_2CH_2OH$, —$CH_2CH_2OCH_2CONH_2$, —$CH_2CONHCH_3$,

—$CH_2NHCOCH_3$, —$CH_2CH_2CO_2H$, —$CH_2CH_2CONH_2$, —$CH_2OH$,

—$CH_2CH_2OH$, —$CH_2CO_2H$, —$CH_2CONH_2$,

—$CH_2CONHCH_2CH_2OH$, —$CH_2CON(CH_2CH_2OH)_2$,

—$CH_2SO_2NH_2$, —$CH_2SO_2NHCH_3$, —$CH_2SO_2NHCOCH_3$,

—$CH_2CH_2SO_2N(CH_2CH_2OH)_2$, —$NHCONH_2$, —$NHCONHCH_3$,

—$NHCONHCH_2CH_2OH$, —$NHSO_2CH_2$, —$NHCO_2CH_3$

Of these groups as $R_{13}$ particularly preferred are —$CH_2OH$, —$CON(R_{15})_2$, and —$SO_2N(R_{15})_2$, taking high color developability and ease of synthesis into consideration.

The compound represented by formula (II) may have a form of a dimer or a polymer in which the structure of formula (II) are linked at $R_{11}$ or $R_{12}$ via a di- or polyvalent linking group. This being the case, the number of carbon atoms in $R_{11}$ or $R_{12}$ may be out of the above-specified range.

Specific examples of the compound represented by formula (II) are shown below for illustrative purposes but not for limitation.

(M-49)
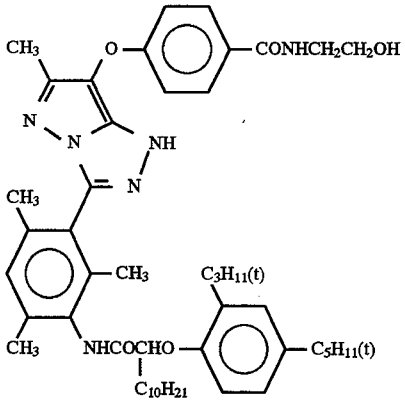
(M-50)
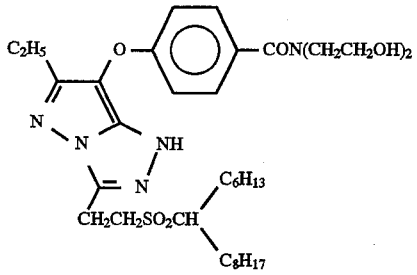
(M-51)
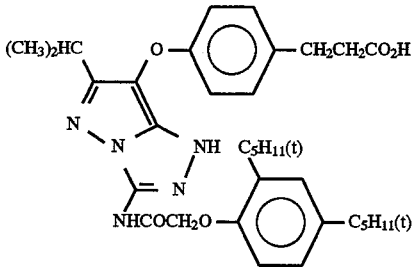
(M-52)
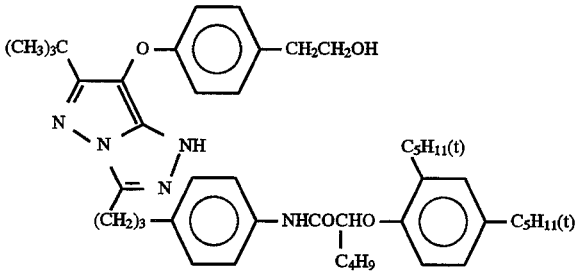
(M-53)
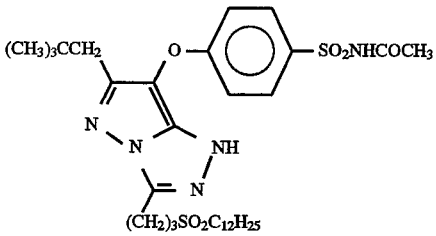
(M-54)
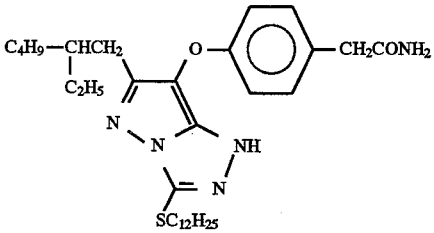
(M-55)
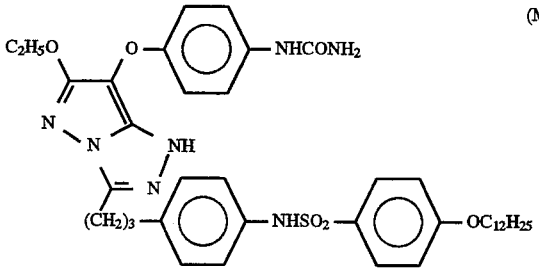
(M-56)
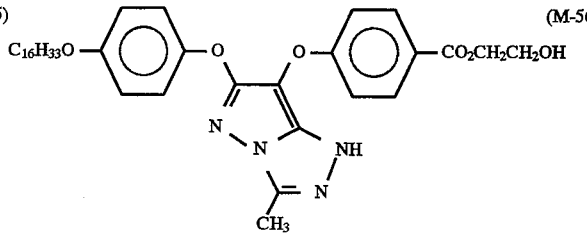

-continued
(M-57)
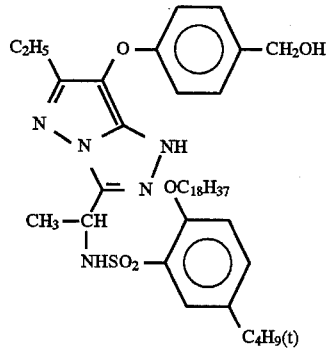
(M-58)
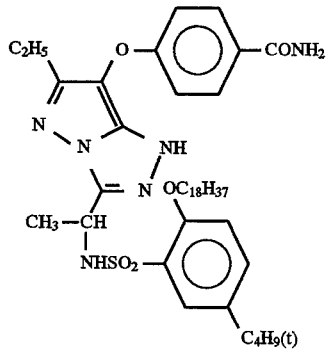
(M-59)
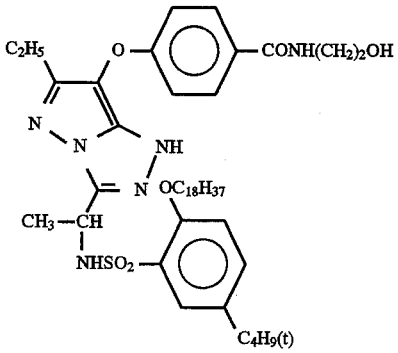
(M-60)
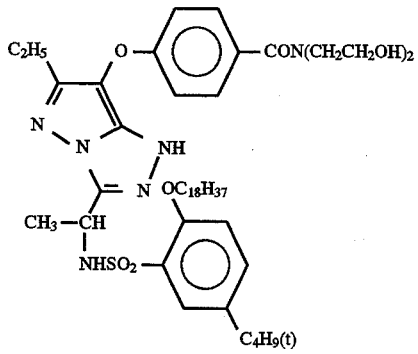
(M-61)
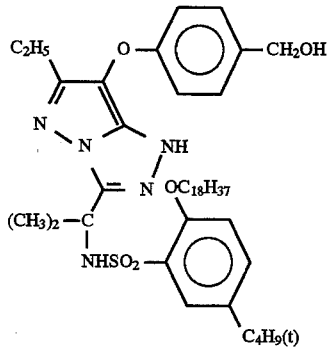
(M-62)
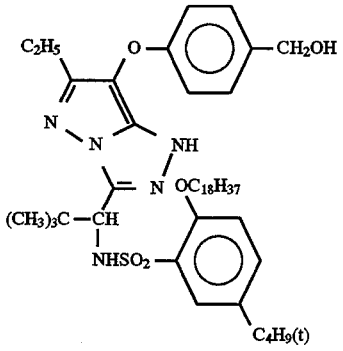
(M-63)
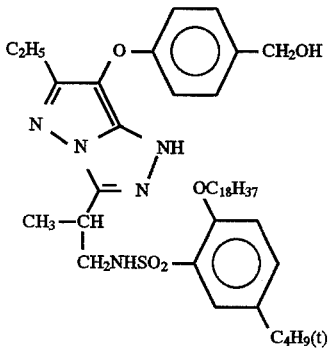
(M-64)
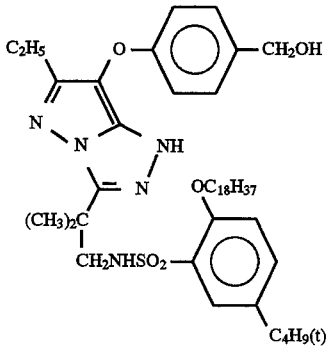

-continued
(M-65)
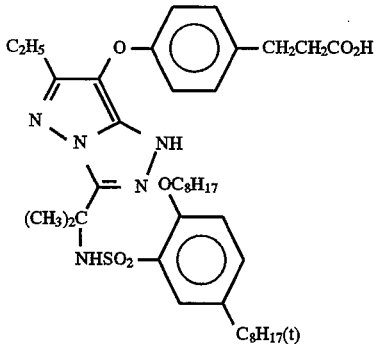
(M-66)
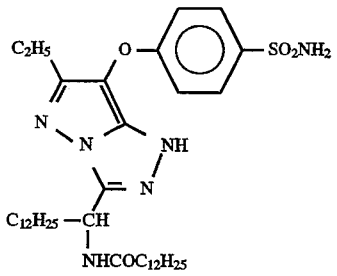
(M-67)
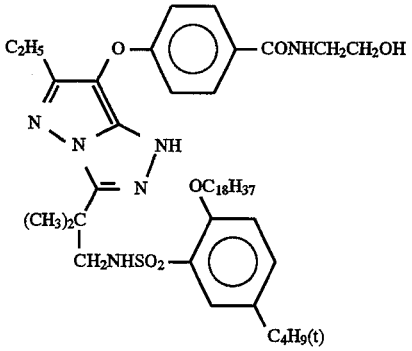
(M-68)
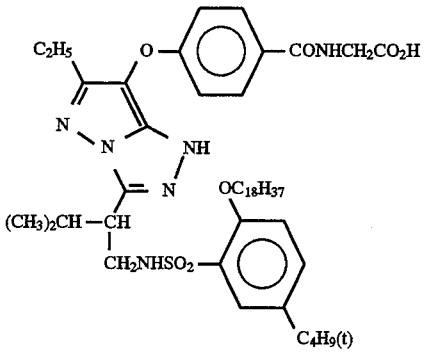
(M-69)
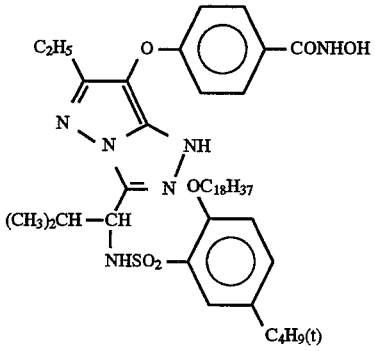
(M-70)
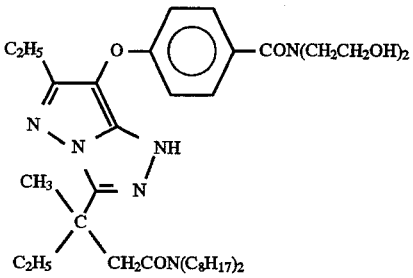
(M-71)
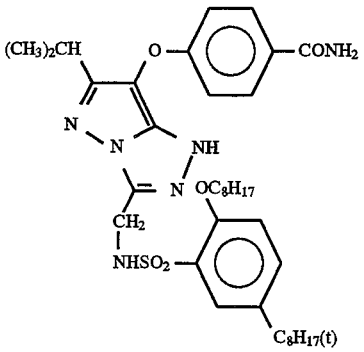
(M-72)
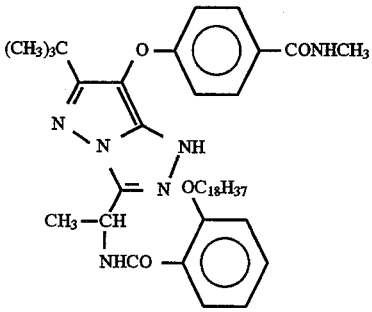

-continued
(M-73)
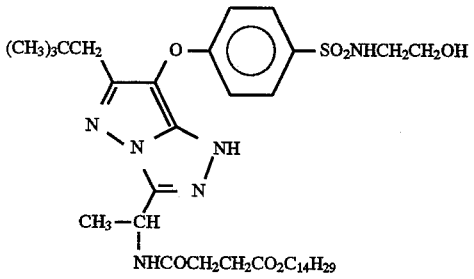
(M-74)
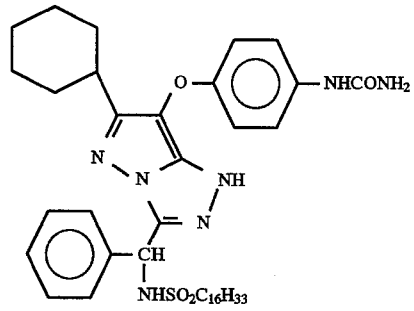
(M-75)
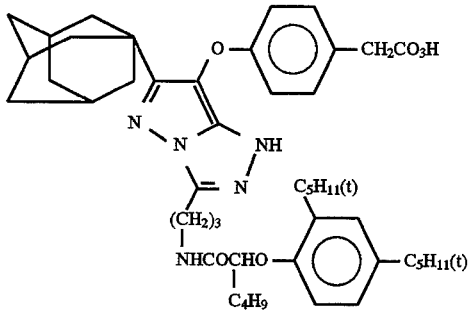
(M-76)
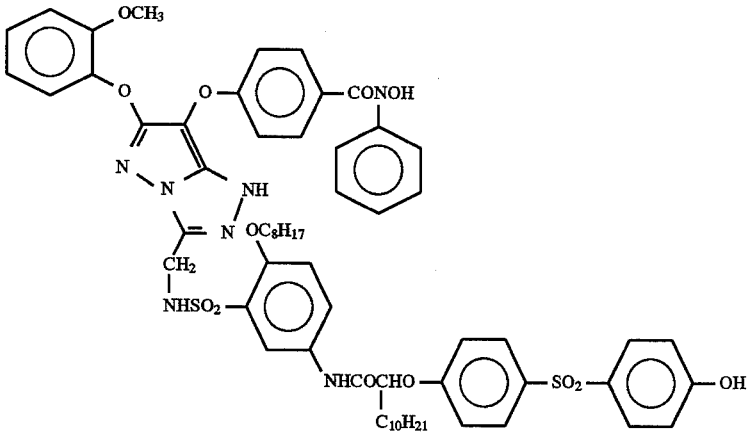
(M-77)
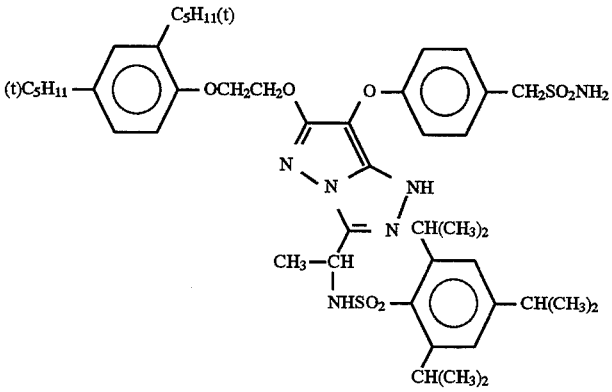

-continued
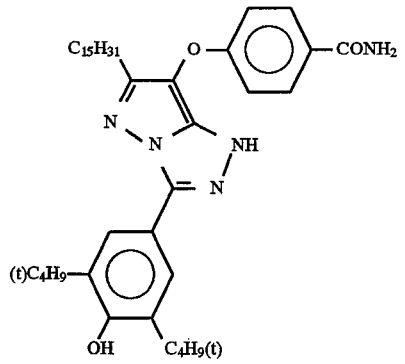
(M-78)
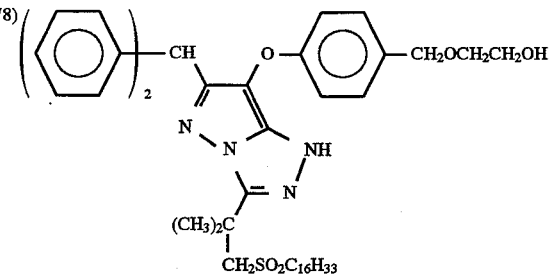
(M-79)
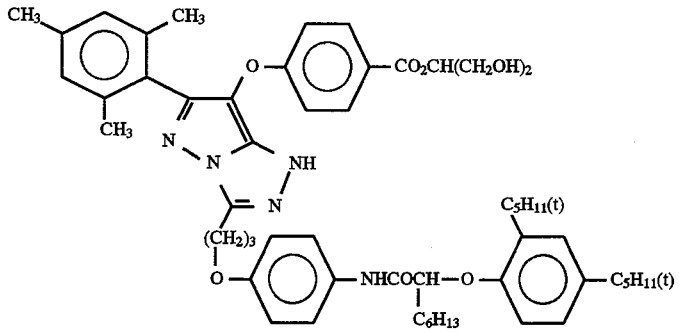
(M-80)
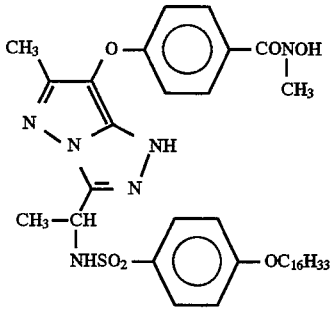
(M-81)
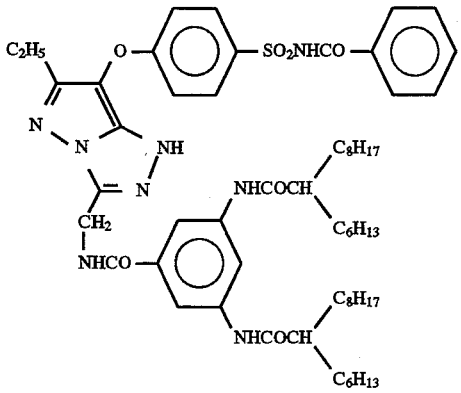
(M-82)
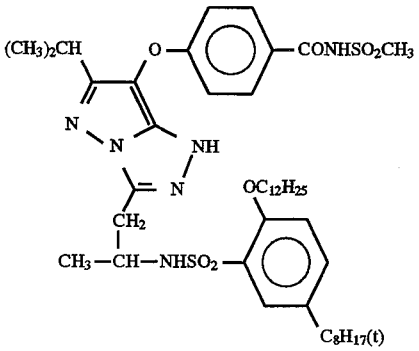
(M-83)
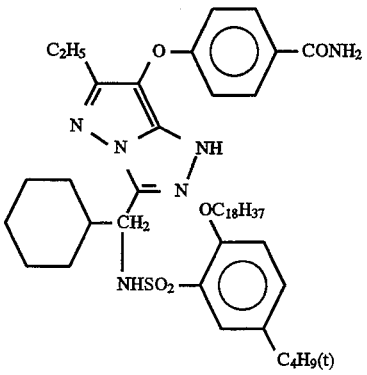
(M-84)

-continued (M-85)

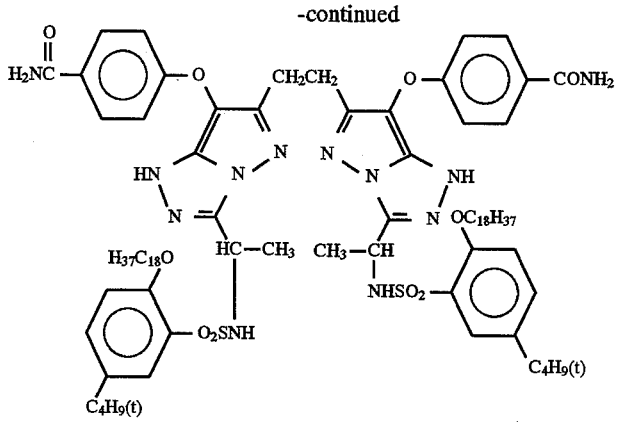

(M-86)

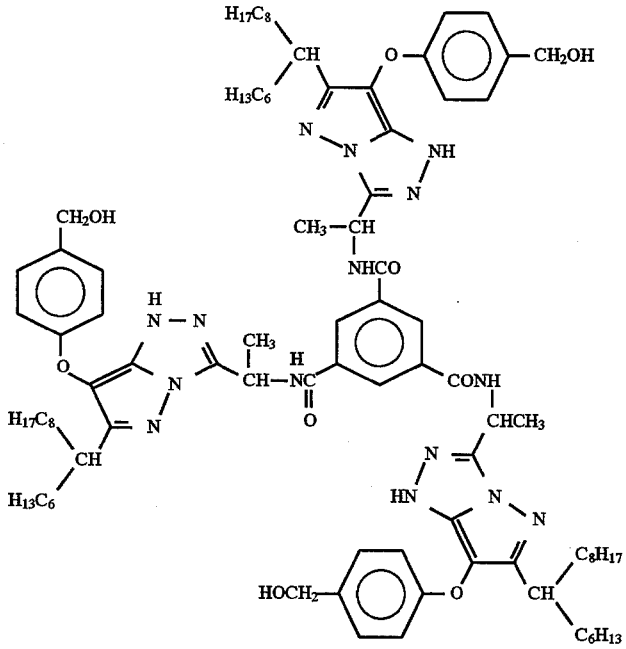

(M-87)

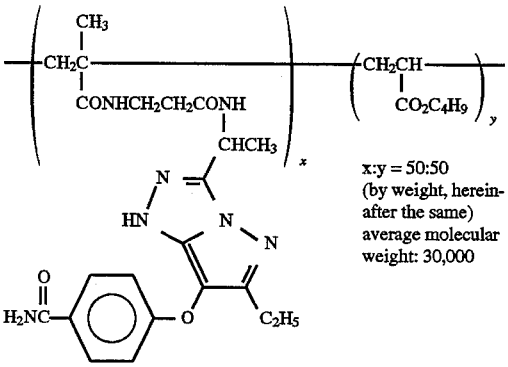

x:y = 50:50 (by weight, hereinafter the same) average molecular weight: 30,000

(M-88)

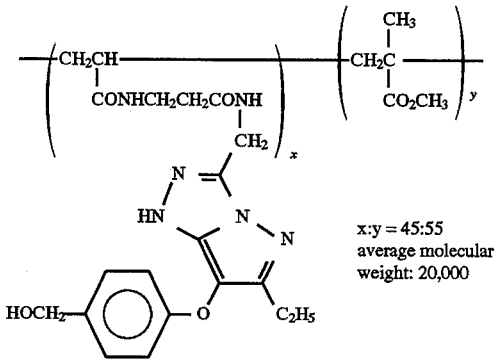

x:y = 45:55 average molecular weight: 20,000

5-Amino-1H-pyrazole compounds which are starting compounds for preparing the pyrazolotriazole couplers of the present invention can be synthesized by the process described in JP-A-4-66573 and JP-A-4-66574. 3(5)-Hydrazinopyrazole compounds which are intermediates for preparing the pyrazolotriazole couplers can be synthesized by the process described in JP-A-4-364170. The skeleton of the pyrazolotriazole couplers of the present invention can be synthesized in accordance with the process disclosed in JP-A-3-220191 and JP-A-5-204106. Typical examples of the synthesis of the compounds represented by formulae (I) and (II) are given below.

SYNTHESIS EXAMPLE 1

Synthesis of Compound (M-1)

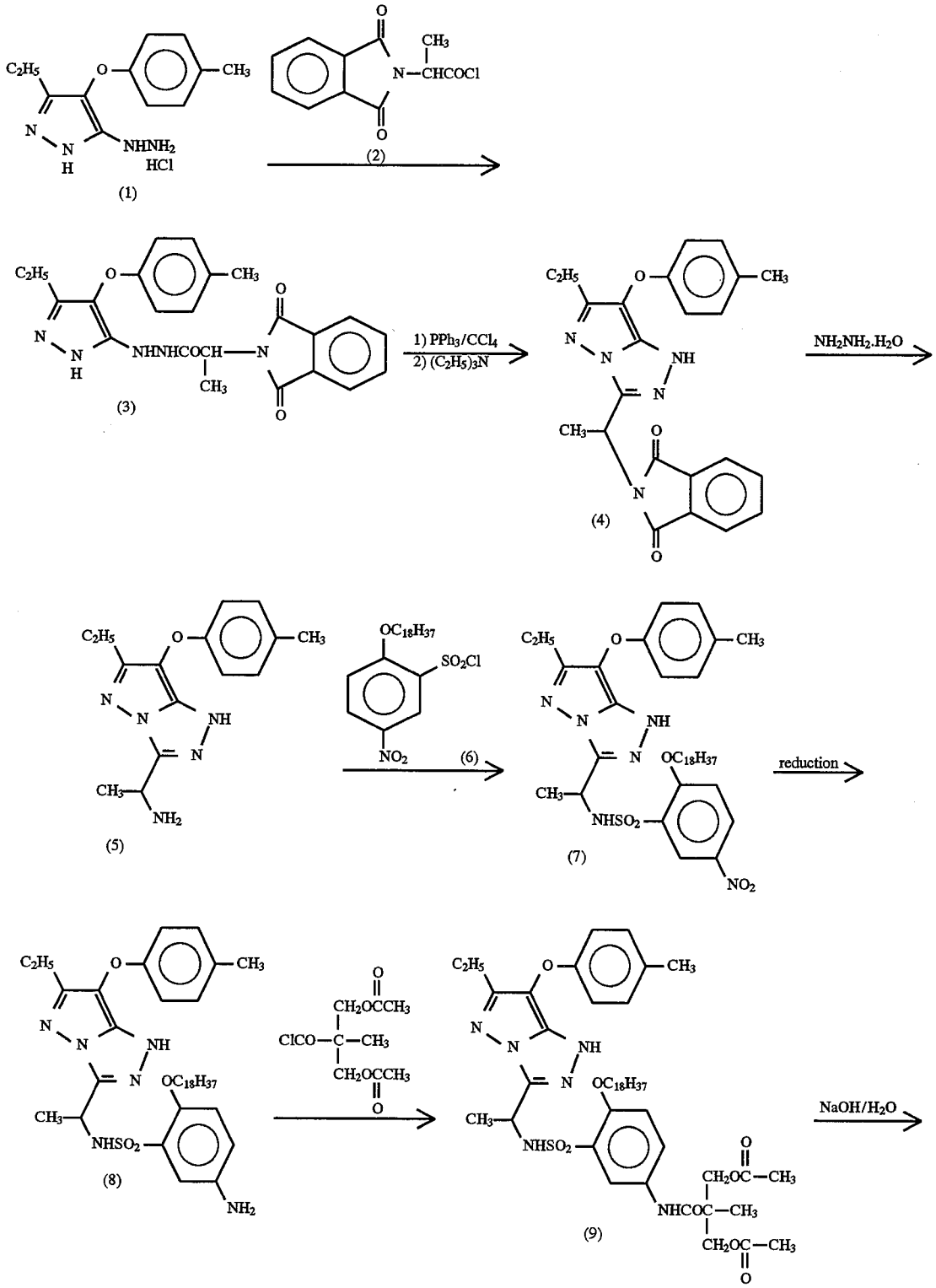
(1)
(2)
(3)
1) PPh3/CCl4
2) (C2H5)3N
(4)
NH2NH2.H2O
(5)
(6)
(7)
reduction
(8)
(9)
NaOH/H2O -continued

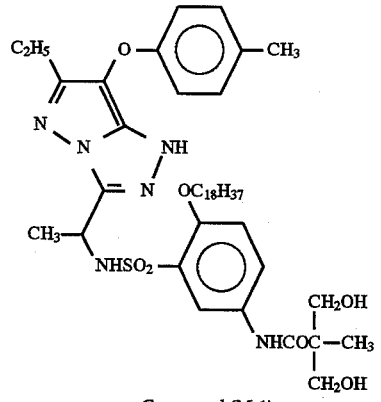

Compound (M-1)

1) Synthesis of Intermediate (3):

Intermediate (1) (98.1 g, 0.365 mol) was stirred in 1 l of acetonitrile while cooling with water, and 204 ml (1.46 mol) of triethylamine was added thereto, followed by stirring for 10 minutes. To the mixture was added 86.7 g (0.365 ml) of compound (2), followed by stirring for 3 hours. The reaction mixture was extracted with a mixed solvent of 1.5 l of water and 1 l of ethyl acetate. The organic layer was washed successively with 800 ml of diluted hydrochloric acid and 800 ml of a saturated aqueous solution of sodium chloride and dried over anhydrous sodium sulfate. Ethyl acetate was evaporated under reduced pressure to give intermediate (3), which was used in the subsequent reaction without purification.

2) Synthesis of Intermediate (4):

Intermediate (3) (99 g, 0.228 mol) prepared above was dissolved in 600 ml of acetonitrile, and 140 g (0.912 ml) of carbon tetrachloride was added thereto, followed by stirring at room temperature. To the mixture was added 89.9 g (0.342 mol) of triphenylphosphine, followed by stirring for 1 hour. The reaction mixture was further stirred under reflux for 2 hours and, after cooling to room temperature with water, poured into a mixture of 600 ml of ethyl acetate and 800 ml of water. The organic layer was washed with 500 ml of a saturated aqueous sodium chloride solution, and 70 ml (0.5 mol) of triethylamine was added thereto, followed by allowing to stand at room temperature for 10 minutes. The reaction mixture was washed successively with 500 ml of diluted hydrochloric acid and 500 ml of a saturated aqueous sodium chloride solution and dried over anhydrous sodium sulfate. The organic layer was evaporated under reduced pressure, and the residue was purified by silica gel column chromatography. To the purified residue was added 250 ml of acetonitrile, and the precipitated crystals were collected by filtration to give 48.8 g (51.5%) of intermediate (4). The structure of the product was identified by $^1$H-NMR and mass spectrum. The melting point was 186° to 187° C.

3) Synthesis of Intermediate (5):

Intermediate (4) (37 g, 0.089 mol) was dissolved in isopropyl alcohol, and 5.3 g (0.106 mol) of hydrazine hydrate was added to the solution at room temperature while stirring, followed by further stirring for 30 minutes. The reaction mixture was heat refluxed for 2 hours, followed by cooling to room temperature with water. Any insoluble matter was removed by filtration, and the organic solvent of the filtrate was removed by evaporation under reduced pressure to give 25 g (98.5%) of intermediate (5) as a glassy substance.

4) Synthesis of Intermediate (7):

Intermediate (5) (10.5 g, 0.037 mol) prepared above was dissolved in a mixed solvent of dimethylacetamide and ethyl acetate. While stirring at room temperature, 18.9 g (0.0368 mol) of compound (6) was added to the solution dropwise, and subsequently 5.6 ml (0.04 mol) of triethylamine was added thereto dropwise. After stirring at room temperature for 2 hours, the reaction mixture was poured into a mixture of 100 ml of ethyl acetate and 100 ml of water. The organic layer was washed successively with 100 ml of diluted hydrochloric acid and 100 ml of a saturated aqueous sodium chloride solution and dried over anhydrous sodium sulfate. The solvent was evaporated under reduced pressure, and the residue was purified by silica gel column chromatography to obtain 17.7 g (65.0%) of intermediate (7) as a glassy substance. The structure of the product was identified by $^1$H-NMR and mass spectrum.

5) Synthesis of Intermediate (8):

Reduced iron (14 g, 0.25 mol) and 1 g (0.019 mol) of ammonium chloride were added to a mixed solvent of 200 ml of isopropyl alcohol and 20 ml of water. The mixture was heated under reflux for 20 minutes, and 23 g (0.031 mol) of intermediate (7) prepared above was added thereto in divided portions. The heat refluxing was further continued for 1 hour, and the reaction mixture was filtered while hot to remove reduced iron. The solvent was removed by evaporation under reduced pressure to obtain 22.1 g (100%) of intermediate (8) as a glassy substance.

6) Synthesis of Intermediate (9):

Intermediate (8) (6.3 g, 0.009 mol) prepared above was dissolved in 80 ml of ethyl acetate. While stirring at room temperature, 2.1 g (0.009 mol) of diacetoxypivalic acid chloride was added to the solution dropwise and then 1.3 ml (0.0093 mol) of triethylamine was added dropwise. The reaction mixture was poured into 100 ml of water. The organic layer was washed successively with 100 ml of diluted hydrochloric acid and 100 ml of a saturated aqueous sodium chloride solution and dried over anhydrous sodium sulfate. The solvent was evaporated, and the residue was purified by silica gel column chromatography to obtain 8.5 g (90.4%) of intermediate (9) as an oily substance.

7) Synthesis of Compound (M-1):

Intermediate (9) (8.5 g, 0.0094 mol) prepared above was dissolved in 30 ml of ethanol, and a solution of 1.9 g (0.048 mol) of sodium hydroxide in 20 ml of water was added thereto dropwise while stirring at room temperature. After stirring at room temperature for 1 hour, the reaction mixture was poured into a mixture of 100 ml of ethyl acetate and 100 ml of water. The organic layer was washed successively with 100 ml of diluted hydrochloric acid and 100 ml of a saturated aqueous sodium chloride solution and dried over sodium sulfate. The solvent was removed by evaporation, and the residue was purified by silica gel column chromatography. the solvent was evaporated from the eluate to give 5.8 g (75.0%) of compound (M-1) as a powder. The structure of the product was identified by $^1$H-NMR and mass spectrum.

$^1$H-NMR ($CDCl_3$) δ ppm (multiplicity, number of protons): 10.96 (s, 1H), 9.12 (s, 1H), 7.70 (d,d, 1H), 7.57 (d, 1H), 7.04 (d, 2H), 6.72 (d, 2H), 6.60 (d, 1H), 6.20 (d, 1H), 4.99–4.78 (m, 1H), 4.38–3.90 (br, 2H), 3.91–3.54 (m, 6H), 2.66–2.45 (m, 2H), 2.27 (s, 3H), 1.91–1.65 (m, 2H), 1.71 (d, 3H), 1.52–1.10 (m, 30H), 1.19 (t, 3H), 1.08 (s, 3H), 0.87 (t, 3H)

SYNTHESIS EXAMPLE 2

Synthesis of Compound (M-3)

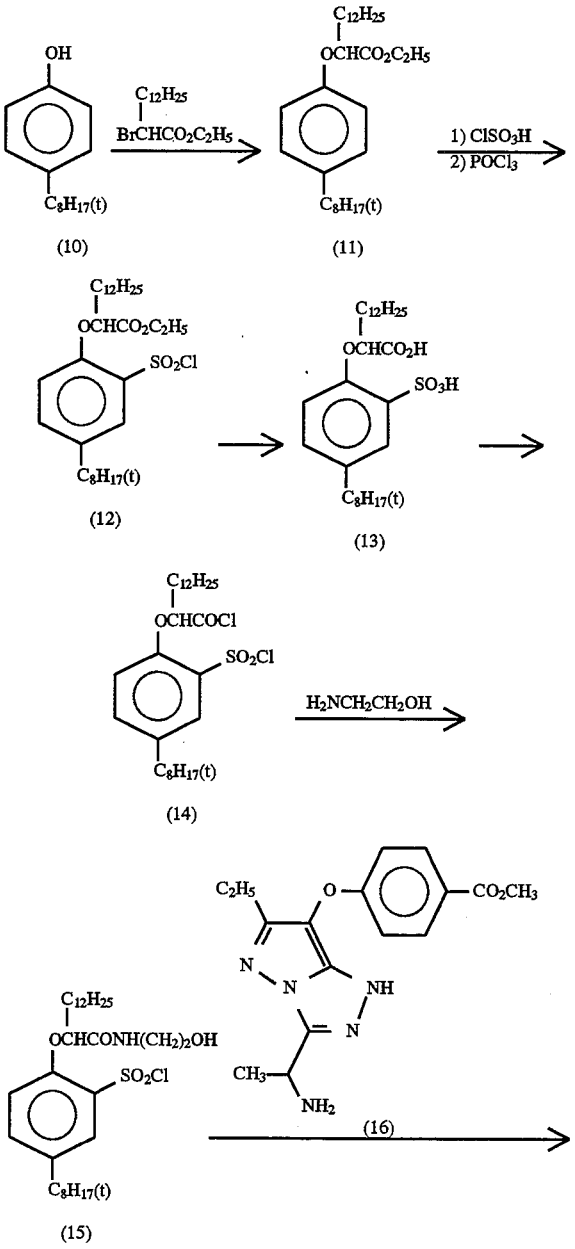

-continued

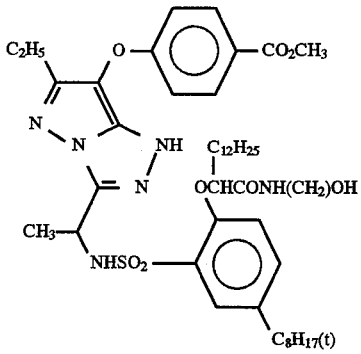

Compound (M-3)

1) Synthesis of Intermediate (11):

Compound (10) (20.6 g, 0.1 mol), 40.3 g (0.12 mol) of ethyl α-bromomyristate, and 27.6 g (0.2 mol) of potassium carbonate were added to 200 ml of dimethylformamide. The mixture was stirred at 80° to 90° C. for 5 hours, followed by cooling with water to room temperature. Excess potassium carbonate was removed, and the reaction mixture was poured into a mixture of 300 ml of ethyl acetate and 300 ml of water. The organic layer was washed with three 300 ml portions of a saturated aqueous sodium chloride solution and dried over anhydrous sodium sulfate. The solvent was removed by evaporation under reduced pressure to give 50.4 g (100%) of intermediate (11) as an oily substance.

2) Synthesis of Intermediate (12):

Intermediate (11) (50.4. g, 0.1 mol) prepared above was dissolved in 200 ml of methylene chloride, and 10 ml (0.14 mol) of chlorosulfonic acid was added thereto dropwise with stirring under cooling with ice while maintaining at 10° C. or lower, followed by stirring at 10° C. for 1 hour and then at room temperature for 1 hour. A mixed solvent of 90 ml of dimethylacetamide and 45 ml of acetonitrile was then added thereto dropwise while cooling with water. Phosphorus oxychloride (18.4 ml, 0.2 mol) was added thereto while heating under reflux. After heat refluxing was further continued for an additional period of 1 hour, the reaction mixture was cooled with water to room temperature, poured into ice-water, and extracted with 300 ml of ethyl acetate. The extract was washed with three 300 ml portions of a saturated aqueous sodium chloride solution and dried over anhydrous sodium sulfate. The solvent was evaporated under reduced pressure to obtain 55.9 g (100%) of intermediate (12) as an oily substance.

2) Synthesis of Intermediate (13):

Sodium hydroxide (20 g, 0.5 mol) was dissolved in a mixed solvent of 40 ml of water and 110 ml of ethanol. The solution was heated up to 50° C., and 55.9 g (0.1 mol) of intermediate (12) prepared above was added thereto dropwise over 20 minutes while stirring. The mixture was heated under reflux for 30 minutes and then rendered acidic by addition of 52 ml of concentrated hydrochloric acid. The reaction mixture was poured into a mixture of 300 ml of ethyl acetate and 300 ml of water. The organic layer was washed with an aqueous hydrochloric acid solution and dried over magnesium sulfate. The solvent was evaporated under reduced pressure to give 46 g (89.9%) of intermediate (13) as an oily substance.

3) Synthesis of Intermediate (14):

intermediate (13) (46 g, 0.072 mol) prepared above was dissolved in a mixed solvent of 130 ml of acetonitrile and 65 ml of dimethylacetamide, and 26.7 ml (0.29 mol) of phosphorus oxychloride was added thereto dropwise over 30 minutes while stirring at room temperature. The reaction mixture was stirred at room temperature for 30 minutes and then at 50° to 60° C. for 30 minutes, followed by allowing to cool to room temperature. The reaction mixture was extracted with two 200 ml portions of n-hexane. n-Hexane was removed by evaporation under reduced pressure to give 44.6 g (80.5%) of intermediate (14) as an oily substance.

4) Synthesis of Intermediate (15):

2-Hydroxyethylamine (1.5 g, 0.024 mol) and 6.1 g (0.072 mol) of sodium hydrogencarbonate were added to a mixed solvent of 70 ml of ethyl acetate and 150 ml of water. To the solution was added dropwise 13.2 g (0.024 mol) of intermediate (14) prepared above over 15 minutes, followed by stirring for 30 minutes. The organic layer was washed with a saturated aqueous sodium chloride solution and dried over magnesium sulfate. The solvent was evaporated under reduced pressure, and the residue was purified by column chromatography. The solvent was evaporated under reduced pressure to obtain 12.3 g (88.6%) of intermediate (15) as an oily substance.

5) Synthesis of Compound (M-3):

Intermediate (16) (3.6 g, 0.011 mol) was dissolved in 22 ml (0.189 mol) of 2,6-lutidine. Intermediate (15) (6.3 g, 0.011 mol) prepared above was added to the solution dropwise over 20 minutes while stirring and cooling with water. After stirring for an additional period of 1 hour, the reaction mixture was poured into a mixed solvent of 100 ml of ethyl acetate and 150 ml of water, made weakly acidic with 20 ml of concentrated hydrochloric acid, washed with a saturated aqueous sodium chloride solution, and dried over magnesium sulfate. The solvent was evaporated under reduced pressure, and the residue was purified by column chromatography. The solvent was evaporated under reduced pressure to give 7.6 g (79.4%) of compound (M-3). The structure of the product was identified by $^1$H-NMR and mass spectrum.

$^1$H-NMR ($CDCl_3$) δ ppm (multiplicity, number of protons): 10.73 (s, 0.5H), 9.86 (s, 0.5H), 8.15 (t, 0.5H), 8.00–7.80 (m, 3H), 7.73 (t, 0.5H), 7.55–7.38 (m, 1H), 6.97–6.73 (m, 3.5H), 6.20 (d, 0.5H), 5.19–5.00 (m, 0.5H), 4.91–4.79 (m, 0.5H), 4.82 (t, 0.5H), 4.70 (t, 0.5H), 4.63–4.25 (br, 1H), 3.89 (s, 3H), 3.97–2.95 (m, 3H), 3.70 (t, 1H), 2.65–2.50 (m, 2H), 2.13–1.93 (m, 2H), 1.85–1.40 (m, 7H), 1.40–1.10 (m, 27H), 0.88 (t, 3H), 0.70 (s, 4.5H), 0.60 (s, 4.5H).

SYNTHESIS EXAMPLE 3

Synthesis of Compound (M-58)

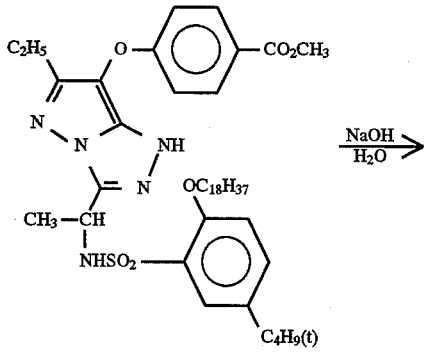

(17)

-continued

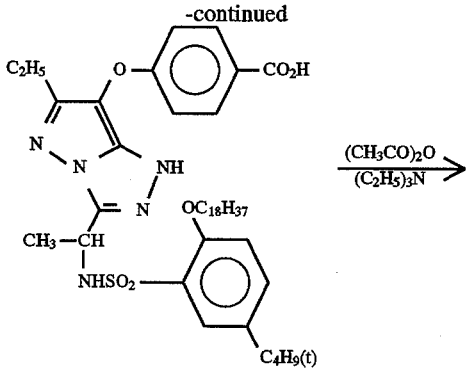

(18)

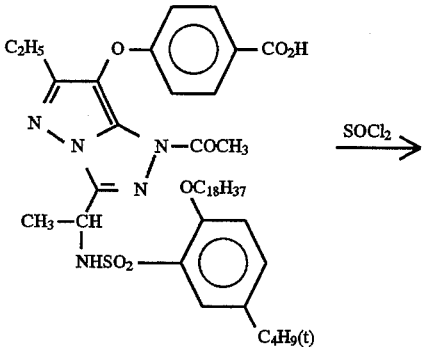

(19)

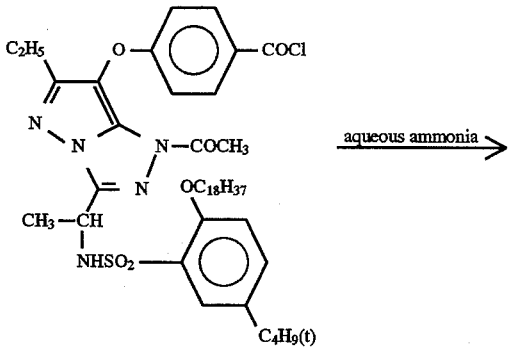

(20)

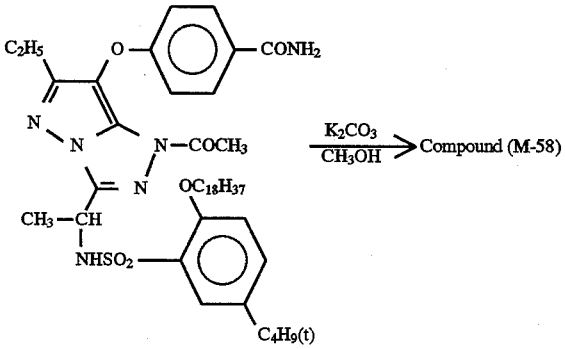

(21)

1) Synthesis of Intermediate (18):

In 300 ml of methanol was dissolved 60 g (0.076 mol) of compound (17) described in JP-A-5-204106, and 100 ml of water and 15 g (0.37 mol) of sodium hydroxide were successively added to the solution. After stirring at 60° C. for 2 hours, the reaction mixture was poured into diluted hydrochloric acid. The precipitated crystals were collected by filtration, washed with water, and dried to obtain 58.3 g (99%) of intermediate (18).

2) Synthesis of Intermediate (19):

Intermediate (18) (56.4 g, 0.072 mol) was dissolved in 150 ml of N,N-dimethylacetamide, and 18.2 g (0.18 mol) of triethylamine and 7.5 g (0.074 mol) of acetic anhydride were successively added to the solution. After allowing the mixture to react at room temperature for 1 hour, the reaction mixture was rendered acidic by addition of diluted hydrochloric acid and then extracted with ethyl acetate. The organic layer was washed successively with water and a saturated aqueous sodium chloride solution and dried over sodium sulfate. The solvent was evaporated to give 59.0 g (100%) of intermediate (19).

3) Synthesis of Intermediate (20):

Intermediate (19) (15.0 g, 0.018 mol) was dissolved in 100 ml of dichloromethane, and 6.5 g (0.055 mol) of thionyl chloride was added thereto. The mixture was heated under reflux for 1 hours, and the solvent was evaporated to give 15.4 g (100%) of intermediate (20).

4) Synthesis of Intermediate (21):

A 30% aqueous ammonia (6 ml) was added to a mixed solvent of 100 ml of ethyl acetate and 50 ml of water. A solution of 15.4 g (0.018 mol) of intermediate (20) in 50 ml of ethyl acetate was added thereto dropwise, followed by allowing the mixture to react at room temperature for 1 hour. 2N hydrochloric acid (60 ml) was added thereto, and the reaction mixture was extracted with ethyl acetate. The organic layer was washed successively with water and a saturated aqueous sodium chloride solution and dried over sodium sulfate. The solvent was evaporated to give 14.7 g (99%) of intermediate (21).

5) Synthesis of Compound (M-58):

Intermediate (21) (14.7 g, 0.018 mol) was dissolved in 70 ml of methanol, and 2.5 g (0.018 mol) of potassium carbonate was added thereto and allowed to react at room temperature for 1 hour. To the reaction mixture was added 30 ml of 2N hydrochloric acid, and the mixture was extracted with ethyl acetate. The organic layer was washed successively with water and a saturated aqueous sodium chloride solution and dried over sodium sulfate. The solvent was evaporated, and the residue was purified by silica gel column chromatography to obtain 12.6 g (90%) of compound (M-58). The structure of the product was identified by $^1$H-NMR and mass spectrum.

$^1$H-NMR ($CDCl_3$) δ ppm: 0.88 (3H, t), 1.1–1.5 (30H, m), 1.20 (3H, t), 1.28 (9H, s), 1.67 (3H, d), 1.90 (2H, m), 2.60 (2H, q), 3.99 (2H, m), 4.95 (1H, m), 5.95 (1H, brs), 6.10 (1H, d), 6.39 (1H, brs), 6.78 (1H, d), 6.80 (2H, d), 7.45 (1H, dd), 7.58 (2H, d), 7.79 (1H, d), 11.14 (1H, brs)

SYNTHESIS EXAMPLE 4

Synthesis of Compound (M-57)

A solution of 15 g (0.019 mol) of intermediate (17) in 100 ml of tetrahydrofuran was added dropwise to a suspension of 3 g (0.079 mol) of lithium aluminum hydride in 100 ml of tetrahydrofuran While cooling with ice. After the addition, the ice bath was removed, and the mixture was allowed to react for 1 hour. Then, 200 ml of 2N hydrochloric acid was added thereto dropwise with ice-cooling. The reaction mixture was extracted with ethyl acetate, and the organic layer was washed successively with 2N hydrochloric acid, water, and a saturated aqueous sodium chloride solution, and dried over sodium sulfate. The solvent was evaporated, and the residue was purified by silica gel column chromatography to obtain 11.7 g (80%) of compound (M-57). The structure of the product was identified by $^1$H-NMR and mass spectrum.

$^1$H-NMR ($CDCl_3$) δ ppm: 0.88 (3H, t), 1.1–1.6 (30H, m), 1.18 (3H, t), 1.27 (9H, s), 1.66 (3H, d), 1.85 (1H, brs), 1.87 (2H, m), 2.60 (2H, q), 3.90 (2H, m), 4.60 (2H, s), 4.92 (1H, dq), 6.10 (1H, d), 6.70 (1H, d), 6.83 (2H, d), 7.24 (2H, d), 7.40 (1H, dd), 7.78 (1H, d), 9.12 (1H, brs).

The magenta coupler of formula (I) can be incorporated into any of green-sensitive emulsion layers having various sensitivities in a silver halide color photographic material. It is added in an amount of $3\times10^{-5}$ to $3\times10^{-3}$ mol/m$^2$, preferably $3\times10^{-4}$ to $2\times10^{-3}$ mol/m$^2$, still preferably $1\times10^{-4}$ to $1.5\times10^{-3}$ mol/m$^2$. If the amount is less than the above lower limit, the maximum density of the developed color is insufficient. An amount exceeding the above upper limit is more than necessary and uneconomical.

With respect to various techniques and organic and inorganic materials which can be applied to the silver halide photographic emulsions according to the present invention as well as silver halide photographic materials using the emulsions, reference can be made thereto in *Research Disclosure,* No. 308119 (1989).

The following are specific sources in which reference can be made with respect to the items applicable to the color photographic materials of the present invention.

| | | EP-A-436938 | Others |
|---|---|---|---|
| 1) | Layer structure | p. 146, 1. 34–p. 147, 1. 25 | |
| 2) | Silver halide emulsion | p. 147, 1. 26–p. 148. 1. 12 | |
| 3) | Yellow coupler | p. 137, 1. 35–p. 146, 1. 33, p. 149, 11. 21–23 | |
| 4) | Magenta coupler | p. 149, 11. 24–28 | EP-A-421453, p. 3, 1. 5–p. 25, 1. 55 |
| 5) | Cyan coupler | p. 149, 11. 29–33 | EP-A-432804, p. 3, 1. 28–p. 40, 1. 2 |
| 6) | Polymer coupler | p. 149, 11. 34–38 | EP-A-432334, p. 113, 1. 39–p, 123, 1. 37 |
| 7) | Colored coupler | p. 53, 1. 42–p. 137, 1. 34, p. 149, 11. 39–45 | |
| 8) | Other functional couplers | p. 7, 1. 1–p. 53, 1. 41, p. 149, 1. 46–p. 150, 1. 3 | EP-A-435334, p. 3, 1. 1–p. 29, 1. 50 |
| 9) | Antiseptics and antifungals | p. 150, 11. 25–28 | |
| 10) | Formalin scavenger | p. 149, 11. 15–17 | |
| 11) | Other additives | p. 153, 11. 38–47 | EP-A-421453, p. 75, 1. 21–p. 84, 1. 56, p. 27, 1. 40–p. 37, 1. 40 |
| 12) | Dispersing method | p. 150, 11. 4–24 | |
| 13) | Support | p. 150, 11. 32–34 | |
| 14) | Film thickness, film properties | p. 150, 11. 35–49 | |
| 15) | Color development, black-and-white development, fogging | p. 150, 1. 50–p. 151, 1. 47 | EP-A-442323, p. 34, 11. 11–54, p. 35, 11. 14–22 |
| 16) | Desilvering | p. 151, 1. 48–p. 152, 1. 53 | |
| 17) | Automatic processor | p. 152, 1. 54–p. 153, 1. 2 | |
| 18) | Washing and stabilization | p. 153, 11. 3–37 | |

The present invention will now be illustrated in greater detail with reference to Examples, but it should be understood that the present invention is not deemed to be limited thereto.

EXAMPLE 1

The following layers were provided on a 127 μm thick cellulose triacetate film having a subbing layer to prepare a multilayer color light-sensitive material, designated sample 101. The amounts shown below are coating weights per $m^2$. The function of the compound added is not limited to the one described.

| | |
|---|---|
| **1st Layer (Antihalation Layer):** | |
| Black colloidal silver | 0.20 g |
| Gelatin | 1.90 g |
| UV absorber U-1 | 0.10 g |
| UV absorber U-3 | 0.040 g |
| UV absorber U-4 | 0.10 g |
| High boiling organic solvent Oil-1 | 0.10 g |
| Dye E-1 (dispersion of microcrystalline solid) | 0.10 g |
| **2nd Layer (Intermediate Layer):** | |
| Gelatin | 0.40 g |
| Compound Cpd-C | 5.0 mg |
| Compound Cpd-J | 5.0 mg |
| Compound Cpd-K | 3.0 mg |
| High-boiling organic solvent Oil-3 | 0.10 g |
| Dye D-4 | 0.80 mg |
| **3rd Layer (Intermediate Layer):** | |
| Surface- and internal-fogged fine silver iodobromide emulsion (avg. grain size: 0.06 μm; coefficient of variation: 18%; AgI content: 1 mol %) | 0.050 g-Ag |
| Yellow colloidal silver | 0.030 g-Ag |
| Gelatin | 0.40 g |
| **4th Layer (Low-Speed Red-Sensitive Emulsion Layer):** | |
| Emulsion A | 0.30 g-Ag |
| Emulsion B | 0.20 g-Ag |
| Gelatin | 0.80 g |
| Coupler CC-1 | 0.15 g |
| Coupler CC-2 | 0.050 g |
| Coupler CC-3 | 0.050 g |
| Coupler CC-4 | 0.050 g |
| Compound Cpd-C | 5.0 mg |
| Compound Cpd-J | 5.0 mg |
| High-boiling organic solvent Oil-2 | 0.10 g |
| Additive P-1 | 0.10 g |
| **5th Layer (Medium-Speed Red-Sensitive Emulsion Layer):** | |
| Emulsion B | 0.20 g-Ag |
| Emulsion C | 0.30 g-Ag |
| Gelatin | 0.80 g |
| Coupler CC-1 | 0.20 g |
| Coupler CC-2 | 0.050 g |
| Coupler CC-3 | 0.20 g |
| High-boiling organic solvent Oil-2 | 0.10 g |
| Additive P-1 | 0.10 g |
| **6th Layer (High-Speed Red-Sensitive Emulsion Layer):** | |
| Emulsion D | 0.40 g-Ag |
| Gelatin | 1.10 g |
| Coupler CC-1 | 0.30 g |
| Coupler CC-2 | 0.10 g |
| Coupler CC-3 | 0.70 g |
| Additive P-1 | 0.10 g |
| **7th Layer (Intermediate Layer):** | |
| Gelatin | 0.60 g |
| Additive P-2 | 0.30 g |
| Color mixture preventive Cpd-I | 2.6 mg |
| Dye D-5 | 0.020 g |
| Dye D-6 | 0.010 g |
| Compound Cpd-J | 5.0 mg |
| High-boiling organic solvent Oil-1 | 0.020 g |
| **8th Layer (Intermediate Layer):** | |
| Surface- and internal-fogged silver iodobromide emulsion (avg. grain size: 0.06 μm; coefficient of variation: 16%; AgI content: 0.3 mol %) | 0.020 g-Ag |
| Yellow colloidal silver | 0.020 g-Ag |
| Gelatin | 1.00 g |
| Additive P-1 | 0.20 g |
| Color mixture preventive Cpd-A | 0.10 g |
| Compound Cpd-C | 0.10 g |
| **9th Layer (Low-Speed Green-Sensitive Emulsion Layer):** | |
| Emulsion E | 0.10 g-Ag |
| Emulsion F | 0.20 g-Ag |
| Emulsion G | 0.20 g-Ag |
| Gelatin | 0.50 g |
| Coupler MC-1 | 0.25 g |
| Compound Cpd-B | 0.030 g |
| Compound Cpd-D | 0.020 g |
| Compound Cpd-E | 0.020 g |
| Compound Cpd-F | 0.040 g |
| Compound Cpd-J | 10 mg |
| Compound Cpd-L | 0.020 g |
| High-boiling organic solvent Oil-2 | 0.20 g |
| **10th Layer (Medium-Speed Green-Sensitive Emulsion Layer):** | |
| Emulsion G | 0.20 g-Ag |
| Emulsion H | 0.10 g-Ag |
| Gelatin | 0.60 g |
| Coupler MC-1 | 0.20 g |
| Compound Cpd-B | 0.030 g |
| Compound Cpd-D | 0.020 g |
| Compound Cpd-E | 0.020 g |
| Compound Cpd-F | 0.050 g |
| Compound Cpd-L | 0.050 g |
| High-boiling organic solvent Oil-2 | 0.010 g |
| **11th Layer (High-Speed Green-Sensitive Emulsion Layer):** | |
| Emulsion I | 0.30 g-Ag |
| Gelatin | 1.00 g |
| Coupler MC-1 | 0.30 g |
| Compound Cpd-B | 0.080 g |
| Compound Cpd-E | 0.020 g |
| Compound Cpd-F | 0.040 g |
| Compound Cpd-K | 5.0 mg |
| Compound Cpd-L | 0.020 g |
| High-boiling organic solvent Oil-1 | 0.020 g |
| High-boiling organic solvent Oil-2 | 0.020 g |
| **12th Layer (Intermediate Layer):** | |
| Gelatin | 0.60 g |
| Compound Cpd-L | 0.050 g |
| High-boiling organic solvent Oil-1 | 0.050 g |
| **13th Layer (Yellow Filter Layer):** | |
| Yellow colloidal silver | 0.070 g-Ag |
| Gelatin | 1.10 g |
| Color mixture preventive Cpd-A | 0.010 g |
| Compound Cpd-L | 0.010 g |
| High-boiling organic solvent Oil-1 | 0.010 g |
| Dye E-2 (dispersion of microcrystalline solid) | 0.050 g |
| **14th Layer (Intermediate Layer):** | |
| Gelatin | 0.60 g |
| **15th Layer (Low-Speed Blue-Sensitive Emulsion Layer):** | |
| Emulsion J | 0.20 g-Ag |
| Emulsion K | 0.30 g-Ag |
| Gelatin | 0.80 g |
| Coupler YC-1 | 0.20 g |
| Coupler YC-2 | 0.10 g |
| Coupler YC-3 | 0.40 g |
| **16th Layer (Medium-Speed Blue-Sensitive Emulsion Layer):** | |
| Emulsion L | 0.30 g-Ag |
| Emulsion M | 0.30 g-Ag |

-continued

| | |
|---|---|
| Gelatin | 0.90 g |
| Coupler YC-1 | 0.10 g |
| Coupler YC-2 | 0.10 g |
| Coupler YC-3 | 0.60 g |
| 17th Layer (High-Speed Blue-Sensitive Emulsion Layer): | |
| Emulsion N | 0.20 g-Ag |
| Emulsion O | 0.20 g-Ag |
| Gelatin | 1.20 g |
| Coupler YC-1 | 0.10 g |
| Coupler YC-2 | 0.10 g |
| Coupler YC-3 | 0.60 g |
| High-boiling organic solvent Oil-2 | 0.10 g |
| 18th Layer (1st Protective Layer): | |
| Gelatin | 0.70 g |
| UV absorber U-1 | 0.20 g |
| UV absorber U-2 | 0.050 g |
| UV absorber U-5 | 0.30 g |
| Formalin scavenger Cpd-H | 0.40 g |
| Dye D-1 | 0.15 g |
| Dye D-2 | 0.050 g |
| Dye D-3 | 0.10 g |
| 19th Layer (2nd Protective Layer): | |
| Colloidal silver | 0.10 mg-Ag |
| Fine silver iodobromide emulsion (avg. grain size: 0.06 μm; AgI content: 1 mol %) | 0.10 g-Ag |
| Gelatin | 0.40 g |
| 20th Layer (3rd Protective Layer): | |
| Gelatin | 0.40 g |
| Polymethyl methacrylate (avg. grain size: 1.5 μm) | 0.10 g |
| Methyl methacrylate-acrylic acid (4:6) copolymer (avg. grain size: 1.5 μm) | 0.10 g |
| Silicone oil | 0.030 g |
| Surface active agent W-1 | 3.0 mg |
| Surface active agent W-2 | 0.030 g |

In addition, additives F-1 to F-8 were added to all the emulsion layers, and gelatin hardener H-1 and surfactant for coating and emulsification W-3, W-4, W-5, and W-6 were added to all the 1st to 20th layers. Phenol, 1,2-benzisothiazolin-3-one, 2-phenoxyethanol, phenethyl alcohol, or p-butyl benzoate was added as an antiseptic or an antifungal agent.

The properties of silver iodobromide emulsions A to O used in sample 101 and sensitizing dyes used for spectral sensitization of these emulsions are shown in Tables 1 and 2 below, respectively.

TABLE 1

| Emulsion | Characteristics of Grains | Sphere-equiv. Avg. Grain Size (μm) | Coefficient of Variation (%) | AgI Content (%) |
|---|---|---|---|---|
| A | monodisperse tetradecahedral grains | 0.28 | 16 | 4.0 |
| B | monodisperse cubic grains of internal latent image type | 0.30 | 10 | 4.0 |
| C | monodisperse cubic grains | 0.38 | 10 | 5.0 |
| D | monodisperse tabular grains, average aspect ratio: 3.0 | 0.68 | 8 | 2.0 |
| E | monodisperse cubic grains | 0.20 | 17 | 4.0 |
| F | monodisperse tetradecahedral grains | 0.25 | 16 | 4.0 |

TABLE 1-continued

| Emulsion | Characteristics of Grains | Sphere-equiv. Avg. Grain Size (μm) | Coefficient of Variation (%) | AgI Content (%) |
|---|---|---|---|---|
| G | monodisperse cubic grains of internal latent image type | 0.40 | 11 | 4.0 |
| H | monodisperse cubic grains | 0.50 | 9 | 3.5 |
| I | monodisperse tabular grains, average aspect ratio: 5.0 | 0.80 | 10 | 2.0 |
| J | monodisperse cubic grains | 0.30 | 18 | 4.0 |
| K | monodisperse tetradecahedral grains | 0.45 | 17 | 4.0 |
| L | monodisperse tabular grains, average aspect ratio: 5.0 | 0.55 | 10 | 2.0 |
| M | monodisperse tabular grains, average aspect ratio: 8.0 | 0.70 | 13 | 2.0 |
| N | monodisperse tabular grains, average aspect ratio: 6.0 | 1.00 | 10 | 1.5 |
| O | monodisperse tabular grains, average aspect ratio: 9.0 | 1.20 | 15 | 1.5 |

TABLE 2

| Emulsion | Sensitizing Dye | Amount Added (g/mol-AgX) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |
| I | S-4 | 0.30 |
| | S-5 | 0.070 |
| | S-9 | 0.10 |
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

Note: *AgX: silver halide

CC-1
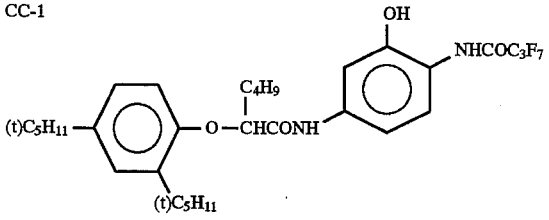
CC-2
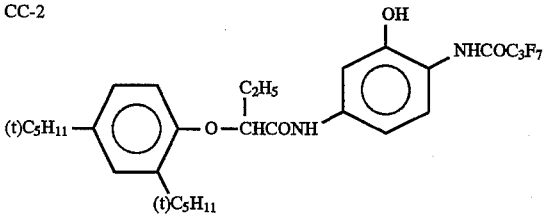
CC-3
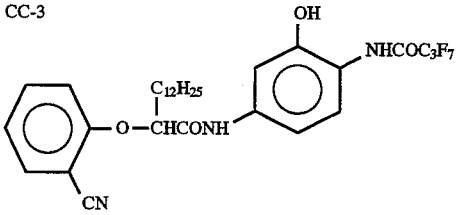
CC-4
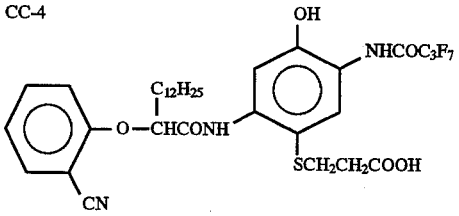
MC-1(compound disclosed in JP-A-5-204106)
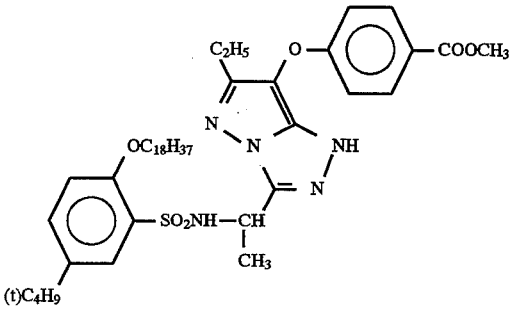
MC-2(compound disclosed in JP-A-62-125349)
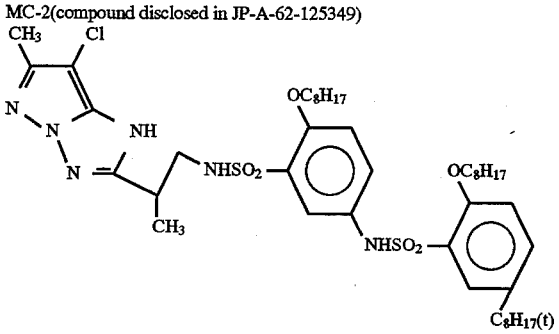
MC-3(compound disclosed in U.S. Pat. No. 4,443,536)
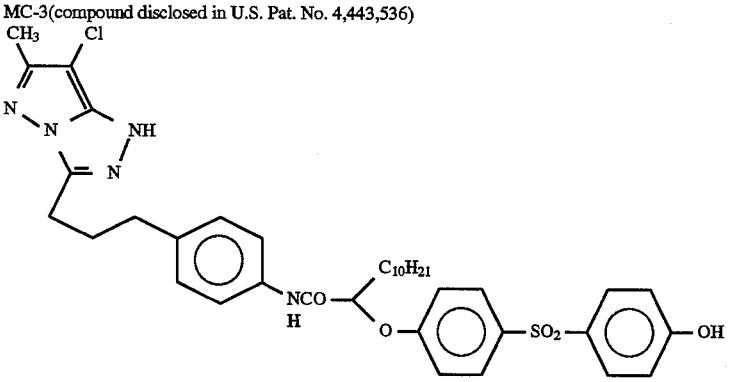
MC-4(compound disclosed in JP-A-4-260033)
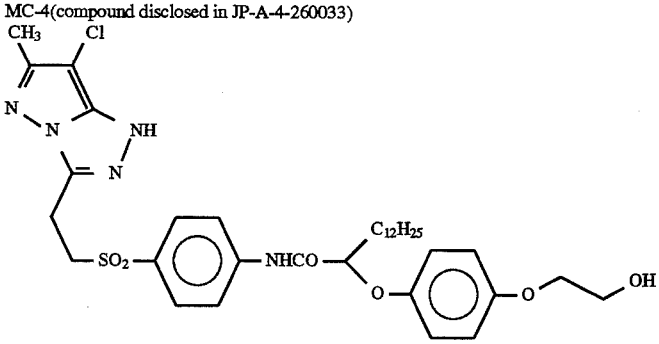

-continued
MC-5(compound disclosed in JP-A-63-30847)
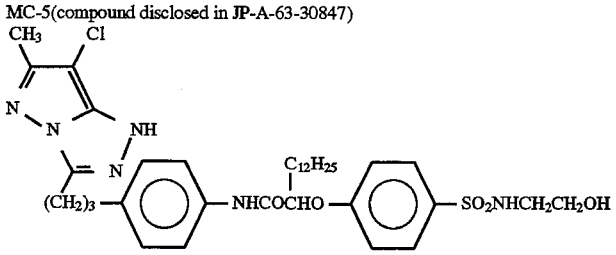
MC-6
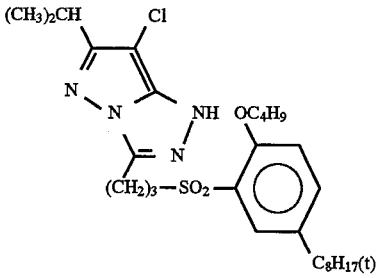
MC-7
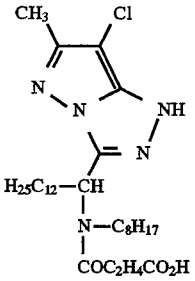
YC-1
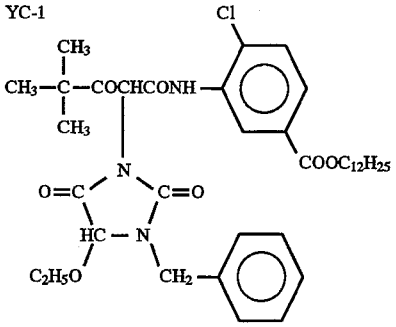
YC-2
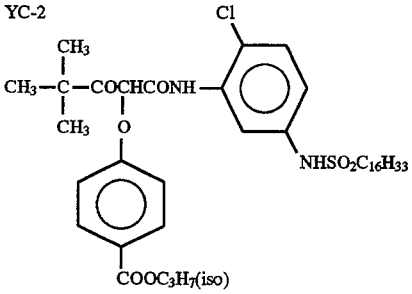
YC-3
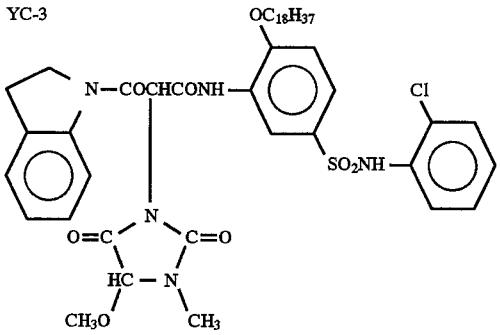
Oil-1 Dibutyl phthalate
Oil-2 Tricresyl phosphate
Oil-3
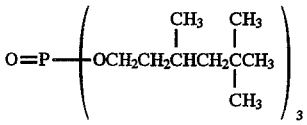
Cpd-A
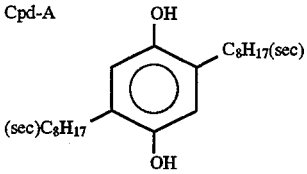
Cpd-B
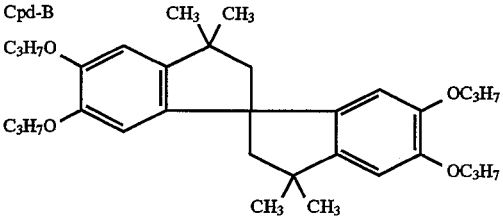

-continued
Cpd-C
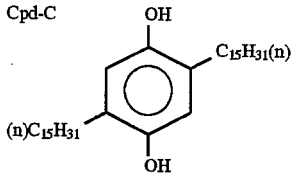
Cpd-D
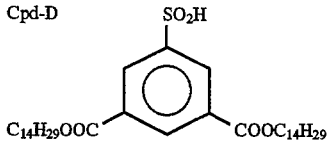
Cpd-E
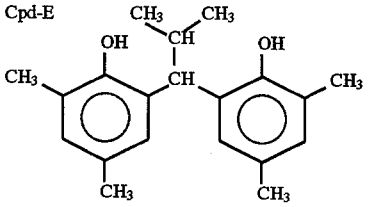
Cpd-F
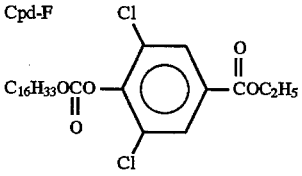
Cpd-H
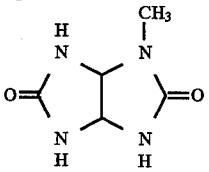
Cpd-I
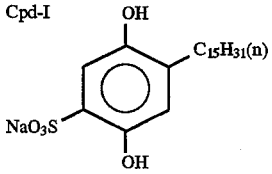
Cpd-J
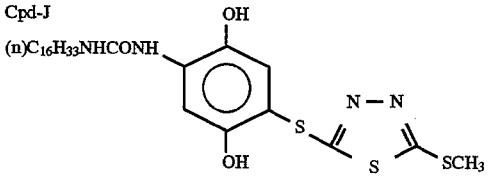
Cpd-K
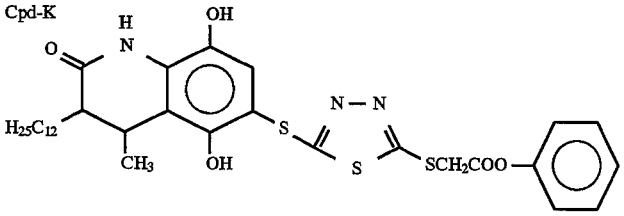
Cpd-L
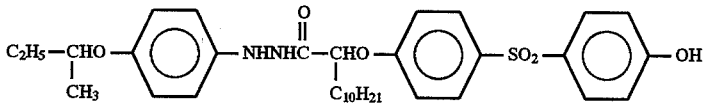
U-1
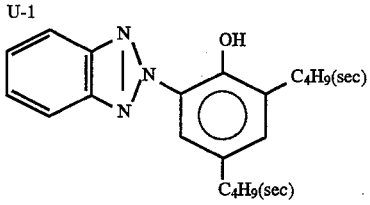
U-2
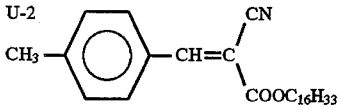
U-3
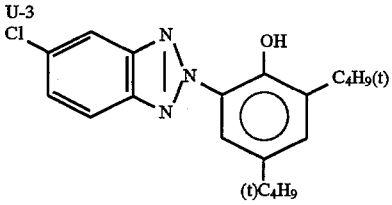
U-4
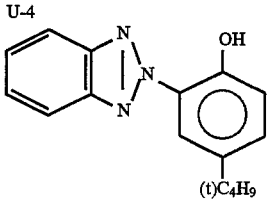

-continued
U-5
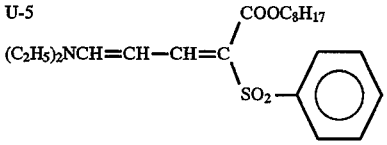
S-1
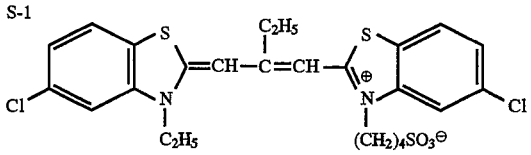
S-2
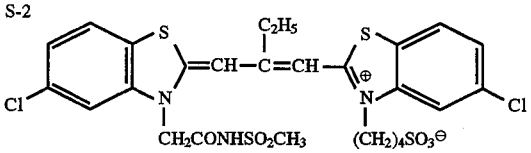
S-3
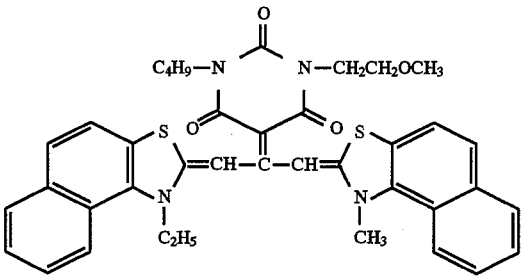
S-4
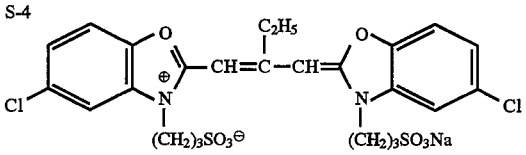
S-5
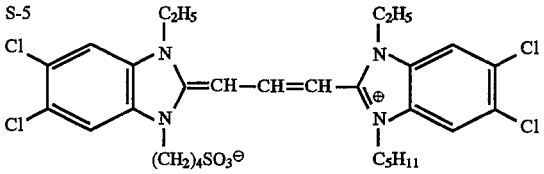
S-6
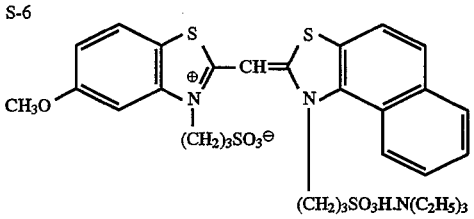
S-7
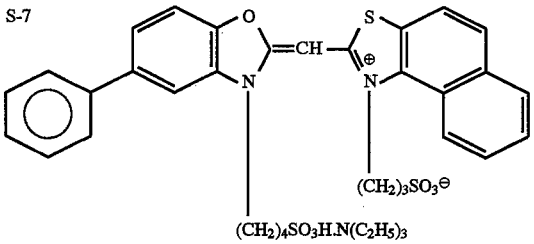
S-8
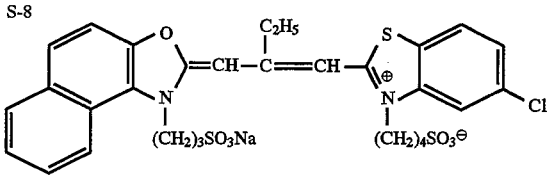
S-9
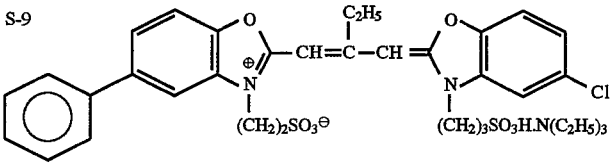
D-1
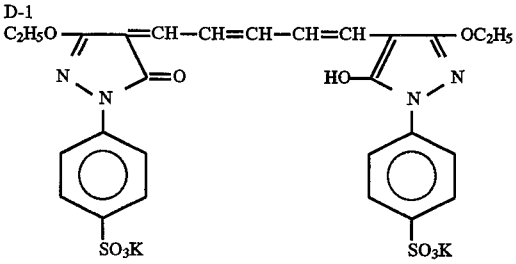
D-2
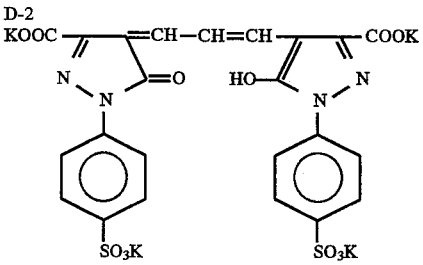

-continued
D-3
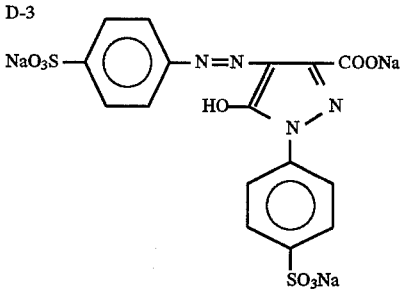
D-4
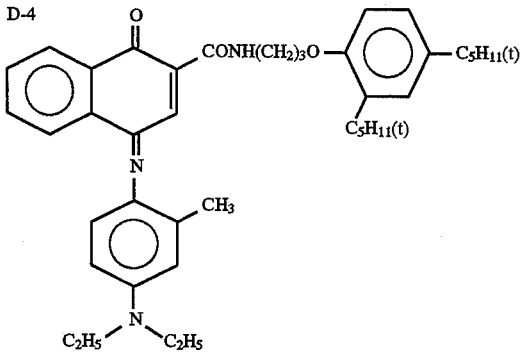
D-5
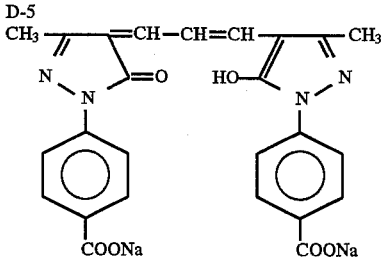
D-6
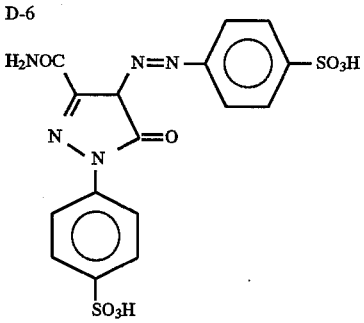
E-1
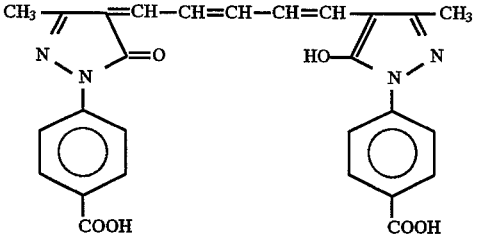
E-2
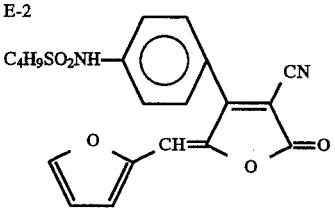
H-1
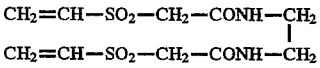
W-1
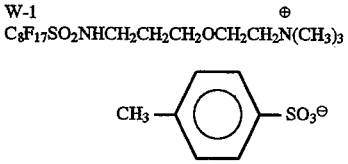
W-2
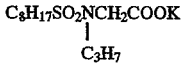
W-3
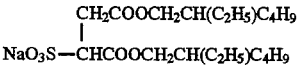
W-4
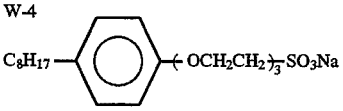
W-5
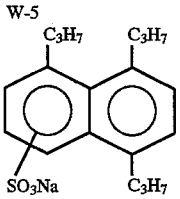
W-6
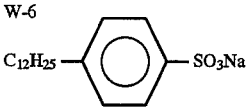
P-1
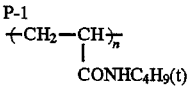

-continued

P-2

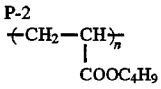

F-1

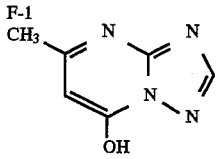

F-2

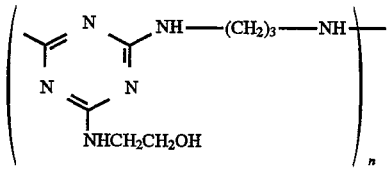

.$HNO_3$ (n = 3~4)

F-3

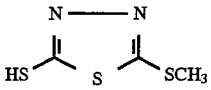

F-4

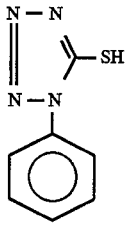

F-5

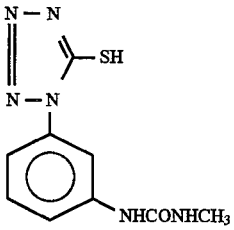

F-6

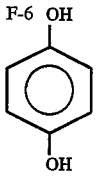

F-7

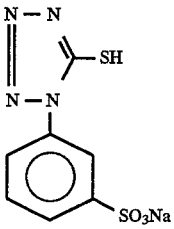

F-8

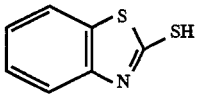

Samples 102 to 125 were prepared in the same manner as for sample 101, except for replacing the coupler MC-1 used in the 9th to 11th layers with the same molar amount of a magenta coupler shown in Table 3.

Each of samples 101 to 125 was wedgewise exposed to white light of 4800° K. and development processed according to the prescription described blow. The maximum magenta density D1 was measured. The results obtained are shown in Table 3. It is seen from Table 3 that the couplers according to the present invention exhibits high color developability.

TABLE 3

| Sample No. | Magenta Coupler | Maximum Density D1 | Remark |
|---|---|---|---|
| 101 | MC-1 | 2.9 | Comparison |
| 102 | MC-2 | 2.3 | " |
| 103 | MC-3 | 3.1 | " |

TABLE 3-continued

| Sample No. | Magenta Coupler | Maximum Density D1 | Remark |
|---|---|---|---|
| 104 | MC-4 | 3.0 | " |
| 105 | MC-5 | 3.0 | " |
| 106 | MC-6 | 2.3 | " |
| 107 | (M-3) | 3.6 | Invention |
| 108 | (M-4) | 3.5 | " |
| 109 | (M-5) | 3.6 | " |
| 110 | (M-6) | 3.4 | " |
| 111 | (M-17) | 3.6 | " |
| 112 | (M-18) | 3.3 | " |
| 113 | (M-20) | 3.9 | " |
| 114 | (M-21) | 3.5 | " |
| 115 | (M-22) | 3.5 | " |
| 116 | (M-33) | 3.4 | " |
| 117 | (M-34) | 3.6 | " |
| 118 | (M-38) | 3.5 | " |
| 119 | (M-46) | 3.7 | " |
| 120 | (M-47) | 3.4 | " |

TABLE 3-continued

| Sample No. | Magenta Coupler | Maximum Density D1 | Remark |
|---|---|---|---|
| 121 | (M-57) | 3.2 | " |
| 122 | (M-58) | 3.1 | " |
| 123 | (M-61) | 3.2 | " |
| 124 | (M-66) | 3.0 | " |
| 125 | (M-82) | 3.1 | " |

After the development processing, samples 101 to 105 and 107 to 120 were irradiated with xenon light (85000 lux) through a UV filter for 1 week at 30° C. and 60% RH, and the magenta density D2 of the area which had the maximum density D1 before irradiation was measured and compared with D1. The results obtained are shown in Table 4 below. It is seen from Table 4 that the magenta coupler of the present invention produces a magenta dye excellent in stability against light, which is a surprising and unpredictable effect.

TABLE 4

| Sample No. | Light Stability $D_2/D_1$ (%) | Remark |
|---|---|---|
| 101 | 80 | Comparison |
| 102 | 78 | " |
| 103 | 62 | " |
| 104 | 68 | " |
| 105 | 70 | " |
| 107 | 92 | Invention |
| 108 | 91 | " |
| 109 | 91 | " |
| 110 | 95 | " |
| 111 | 90 | " |
| 112 | 93 | " |
| 113 | 90 | " |
| 114 | 93 | " |
| 115 | 94 | " |
| 116 | 92 | " |
| 117 | 90 | " |
| 118 | 94 | " |
| 119 | 91 | " |
| 120 | 95 | " |

Further, developed samples 101, 103, 106, and 121 to 125 were preserved at 80° C. and 70% RH for 2 months to examine change in magenta density. The results obtained are shown in Table 5. The results in Table 5 prove the excellent preservability of the dye image produced by the coupler of the present invention.

TABLE 5

| Sample No. | Magenta Density Retention (initial density: 2.0) (%) | Remark |
|---|---|---|
| 101 | 89 | Comparison |
| 103 | 73 | " |
| 106 | 85 | " |
| 121 | 91 | Invention |
| 122 | 92 | " |
| 123 | 91 | " |
| 124 | 93 | " |
| 125 | 94 | " |

Photographic Processing:

| Processing Step | Time (min) | Temp. (°C.) | Tank Capacity (l) | Rate of Replenishment (ml/m²) |
|---|---|---|---|---|
| First development | 6 | 38 | 12 | 2200 |
| First washing | 2 | 38 | 4 | 7500 |
| Reversing | 2 | 38 | 4 | 1100 |
| Color development | 6 | 38 | 12 | 2200 |
| Pre-bleaching | 2 | 38 | 4 | 1100 |
| Bleaching | 6 | 38 | 12 | 220 |
| Fixing | 4 | 38 | 8 | 1100 |
| Second washing | 4 | 38 | 8 | 7500 |
| Final rinsing | 1 | 25 | 2 | 1100 |

The processing solutions used had the following compositions.

| First Developer: | Tank Solution | Replenisher |
|---|---|---|
| Pentasodium nitrilo-N,N,N-trimethylenephosphonate | 1.5 g | 1.5 g |
| Pentasodium diethylenetriaminepentaacetate | 2.0 g | 2.0 g |
| Sodium sulfite | 30 g | 30 g |
| Hydroquinone potassium monosulfate | 20 g | 20 g |
| Potassium carbonate | 15 g | 20 g |
| Sodium hydrogencarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanide | 1.2 g | 1.2 g |
| Potassium iodide | 2.0 mg | — |
| Diethylene glycol | 13 g | 15 g |
| Water to make | 1000 ml | 1000 ml |
| pH (adjusted with sulfuric acid or potassium hydroxide) | 9.60 | 9.60 |

Reversing Bath:

The tank solution and the replenisher had the same composition.

| | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH (adjusted with acetic acid or sodium hydroxide) | 6.00 |

| Color Developer: | Tank Solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Sodium tertiary phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfonamidoethyl)-3-methyl-4-aminoaniline sesquisulfate monohydrate | 11 g | 11 g |
| 3,6-Dithiaoctane-1,8-diol | 1.0 g | 1.0 g |
| Water to make | 1000 ml | 1000 ml |
| pH (adjusted with sulfuric acid or potassium hydroxide) | 11.80 | 12.00 |

-continued

| Pre-Bleaching Bath: | | |
|---|---|---|
| Disodium ethylenediaminetetra-acetate dihydrate | 8.0 g | 8.0 g |
| Sodium sulfite | 6.0 g | 8.0 g |
| 1-Thioglycerol | 0.4 g | 0.4 g |
| Formaldehyde sodium bisulfite adduct | 30 g | 35 g |
| Water to make | 1000 ml | 1000 ml |
| pH (adjusted with acetic acid or sodium hydroxide) | 6.30 | 6.10 |
| **Bleaching Bath:** | | |
| Disodium ethylenediaminetetra-acetate dihydrate | 2.0 g | 4.0 g |
| Ammonium ethylenediaminetetra-acetato ferrate dihydrate | 120 g | 240 g |
| Potassium bromide | 100 g | 200 g |
| Ammonium nitrate | 10 g | 20 g |
| Water to make | 1000 ml | 1000 ml |
| pH (adjusted with nitric acid or sodium hydroxide) | 5.70 | 5.50 |

The tank solution and the replenisher had the same composition.

| | |
|---|---|
| Ammonium thiosulfate | 80 g |
| Sodium sulfite | 5.0 g |
| Sodium bisulfite | 5.0 g |
| Water to make | 1000 ml |
| pH (adjusted with acetic acid or aqueous ammonia) | 6.60 |

| | Tank solution | Replenisher |
|---|---|---|
| **Stabilizing Bath:** | | |
| 1,2-Benzisothiazolin-3-one | 0.02 g | 0.03 g |
| Polyoxyethylene-p-monononyl phenyl ether (average degree of polymerization: 10) | 0.3 g | 0.3 g |
| Polymaleic acid (average molecular weight: 2,000) | 0.1 g | 0.15 g |
| Water to make | 1000 ml | 1000 ml |
| pH | 7.0 | 7.0 |

EXAMPLE 2

A paper support having polyethylene laminated on both sides thereof was subjected to a corona discharge treatment on both sides thereof. A gelatin subbing layer containing sodium dodecylbenzenesulfonate was provided thereon, and various photographic layers were further provided thereon to prepare a multilayer color paper, designated sample 201. Coating compositions were prepared as follows.

Preparation of Coating Composition for Third Layer:

Magenta coupler ExM (120.0 g), dye image stabilizer Cpd-5 (100.0 g), and dye image stabilizer Cpd-6 (10.0 g) were dissolved in a mixture of dye image stabilizer Cpd-7 (10.0 g), dye image stabilizer Cpd-8 (80.0 g), solvent Solv-3 (500 g), and ethyl acetate (360 ml). The resulting solution was emulsified and dispersed in 2000 g of a 16% aqueous gelatin solution containing 60 ml of 10% sodium dodecylbenzenesulfonate and 10 g of citric acid to prepare emulsified dispersion A.

Separately, silver chlorobromide emulsion B was prepared. Silver chlorobromide emulsion B is a 1:3 (by silver molar ratio) mixture of large size emulsion B (cubic; average grain size: 0.55 μm; coefficient of variation of grain size distribution (hereinafter simply referred to as coefficient of variation): 0.10) and small size emulsion B (cubic; average grain size: 0.39 μm; coefficient of variation: 0.08). Both large size emulsion B and small size emulsion B comprise silver chloride grains on the surface of which 0.8 mol % of silver bromide is locally present to form a local AgBr phase. Green-sensitive sensitizing dyes D, E, and F were added to large size emulsion B in an amount of $3.0\times10^{-4}$ mol, $4.0\times10^{-5}$ mol, and $2.0\times10^{-4}$ mol per mol of silver, respectively, and to small size emulsion B in an amount of $3.6\times10^{-4}$ mol, $7.0\times10^{-5}$ mol, and $2.8\times10^{-4}$ mol per mol of silver, respectively. These emulsions were chemically ripened by sulfur sensitization and gold sensitization.

Sensitizing Dye D:

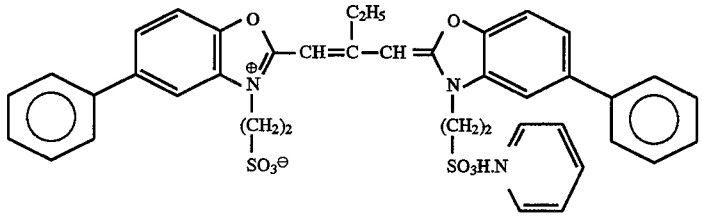

Sensitizing Dye E:

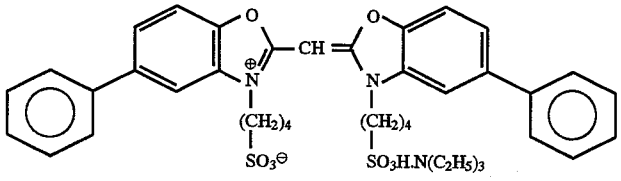

-continued

Sensitizing Dye F:

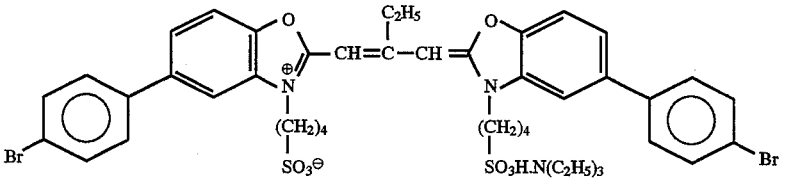

Emulsified dispersion A and silver chlorobromide emulsion B were mixed and dissolved to prepare a coating composition for a third layer having the composition described blow.

Coating compositions for the 1st and 7th emulsion layers were prepared in the same manner as for the one for the third layer.

Each of the 1st to 7th layers contained sodium 1-hydroxy-3,5-dichloro-s-triazine as a gelatin hardener. Further, Cpd-12, Cpd-13, Cpd-14, and Cpd-15 were added to all layers each in a total amount of 15.0 mg/m$^2$, 60.0 mg/m$^2$, 50 mg/m$^2$, and 10.0 mg/m$^2$, respectively.

For a blue-sensitive emulsion layer, spectral sensitizing dyes A, B, and C were added to large size emulsion A each in an amount of $1.4\times10^{-4}$ mol per mol of silver halide and to small size emulsion A each in an amount of $1.7\times10^{-4}$ mol per mol of silver halide.

Sensitizing Dye A:

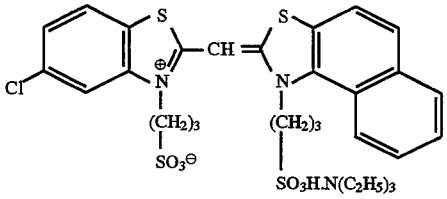

-continued

Sensitizing Dye B:

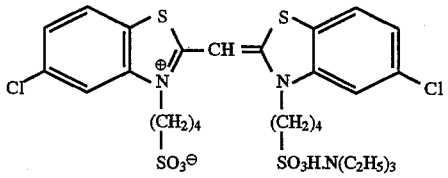

Sensitizing Dye C:

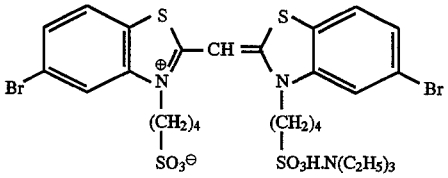

For a red-sensitive emulsion layer, sensitizing dyes G and H were added to large size emulsion C each in an amount of $5.0\times10^{-5}$ mol per mol of silver halide, and to small size emulsion C each in an amount of $8.0\times10^{-5}$ mol per mol of silver halide.

Sensitizing Dye G:

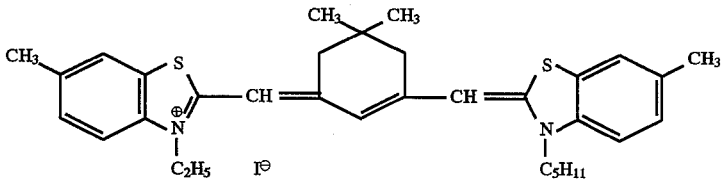

Sensitizing Dye H:

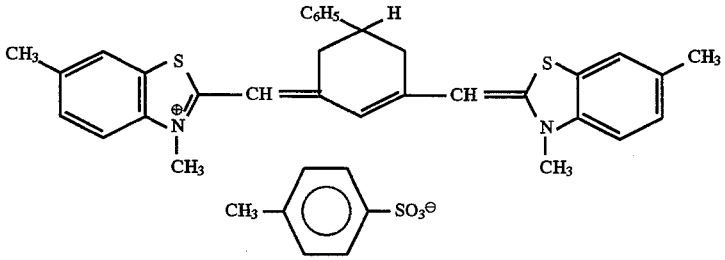

To the red-sensitive emulsion layer was further added $2.6\times10^{-3}$ mol, per mol of silver halide, of a compound of formula:

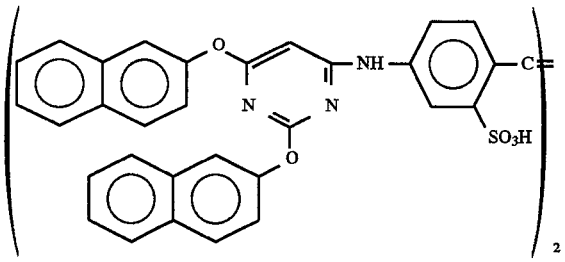

To each of the blue-sensitive, green-sensitive, and red-sensitive emulsion layers was furthermore added 1-(5-methylureidophenyl)-5-mercaptotetrazole in an amount of $3.3\times10^{-4}$ mol, $1.0\times10^{-3}$ mol, and $5.9\times10^{-4}$ mol, respectively, per mol of silver halide. The same compound was also added to each of the 2nd, 4th, 6th, and 7th layers in an amount of 0.2 mg/m$^2$, 0.2 mg/m$^2$, 0.6 mg/m$^2$, and 0.1 mg/m$^2$, respectively.

4-Hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of silver halide.

To each emulsion layer were added the following dyes for antiirradiation in the amount shown.

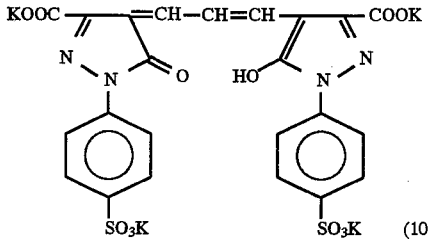

(10 mg/m$^2$)

and

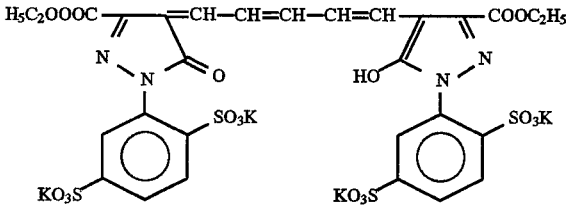

(40 mg/m$^2$)

The layer structure of sample 201 is shown below. The amounts shown are coating weights per m$^2$. Those for silver halide emulsions are coating weights on silver conversion.

Support:

Polyethylene laminate paper (the polyethylene layer on the side to be coated with a first layer contained a white pigment ($TiO_2$) and a blue tingeing dye (ultramarine).

| | |
|---|---|
| 1st Layer (Blue-Sensitive Emulsion Layer): | |
| Silver chlorobromide emulsion [3:7 (Ag molar ratio) mixture of large size emulsion A (cubic; avg. grain size: 0.88 μm; coefficient of variation: 0.08) and small size emulsion A (cubic; avg. grain size: 0.07 μm; coefficient of variation: 0.10); in both emulsions, 0.3 mol % of AgBr was locally present on the grain surface, and the inside and the AgBr local phase contained a total potassium hexachloroiridate (IV) content of 0.05 mg and a total potassium ferrocyanide content of 0.5 mg] | 0.24 g-Ag |
| Gelatin | 1.33 g |
| Yellow coupler ExY | 0.61 g |
| Dye image stabilizer Cpd-1 | 0.08 g |
| Dye image stabilizer Cpd-2 | 0.04 g |
| Dye image stabilizer Cpd-3 | 0.08 g |
| Solvent Solv-1 | 0.22 g |
| 2nd layer (Color Mixture Preventive Layer): | |
| Gelatin | 1.09 g |
| Color mixture preventive Cpd-4 | 0.11 g |
| Solvent Solv-1 | 0.07 g |
| Solvent Solv-2 | 0.25 g |
| Solvent Solv-3 | 0.19 g |
| Solvent Solv-7 | 0.09 g |
| 3rd Layer (Green-Sensitive Emulsion Layer): | |
| Silver chlorobromide emulsion [1:3 (Ag molar ratio) mixture of large size emulsion B (cubic; avg. grain size: 0.55 μm; coefficient of variation: 0.10) and small size emulsion B (cubic; avg. grain size: 0.39 μm; coefficient of variation: 0.08); local AgBr phase on the surface of AgCl substrate: 0.8 mol % (in both emulsions)] | 0.11 g-Ag |
| Gelatin | 1.19 g |
| Magenta coupler ExM | 0.12 g |
| Due image stabilizer Cpd-5 | 0.10 g |
| Dye image stabilizer Cpd-6 | 0.01 g |
| Dye image stabilizer Cpd-7 | 0.08 g |
| Dye image stabilizer Cpd-8 | 0.01 g |
| Solvent Solv-3 | 0.50 g |
| 4th Layer (Color Mixing Preventive Layer): | |
| Gelatin | 0.77 g |
| Color mixture preventive Cpd-4 | 0.08 g |
| Solvent Solv-1 | 0.05 g |
| Solvent Solv-2 | 0.18 g |
| Solvent Solv-3 | 0.14 g |

-continued

| | |
|---|---|
| Solvent Solv-7 | 0.06 g |
| 5th Layer (Red-Sensitive Emulsion Layer): | |
| Silver chlorobromide emulsion | 0.18 g-Ag |
| [1:4 (Ag molar ratio) mixture of large size emulsion C (cubic; avg. grain size: 0.50 μm; coefficient of variation: 0.09) and small size emulsion C (cubic; avg. grain size: 0.41 μm; coefficient of variation: 0.11); local AgBr phase on the surface of AgCl substrate: 0.8 mol % (in both emulsions)] | |
| Gelatin | 0.80 g |
| Cyan coupler ExC | 0.28 g |
| UV absorber UV-3 | 0.19 g |
| Dye image stabilizer Cpd-1 | 0.24 g |
| Dye image stabilizer Cpd-6 | 0.01 g |
| Dye image stabilizer Cpd-8 | 0.01 g |
| Dye image stabilizer Cpd-9 | 0.04 g |
| Dye image stabilizer Cpd-10 | 0.01 g |
| Dolvent Solv-1 | 0.01 g |
| Solvent Solv-6 | 0.21 g |
| 6th Layer (UV Absorbing Layer): | |
| Gelatin | 0.64 g |
| UV Absorber UV-2 | 0.39 g |
| Dye image stabilizer Cpd-7 | 0.05 g |
| Solvent Solv-8 | 0.05 g |
| 7th Layer (Protective Layer): | |
| Gelatin | 1.01 g |
| Acryl-modified polyvinyl alcohol (degree of modification: 17%) | 0.04 g |
| Liquid paraffin | 0.02 g |
| Surface active agent Cpd-11 | 0.01 g |

Yellow coupler ExY

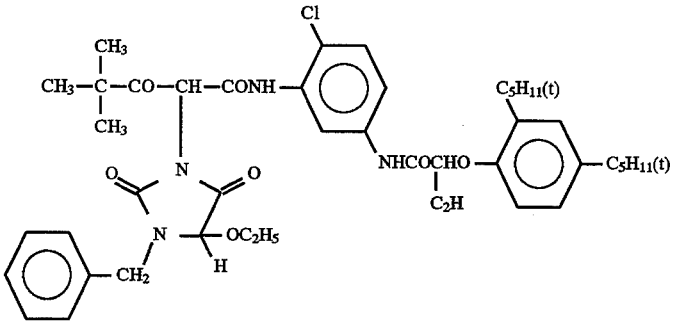

Magenta coupler ExM

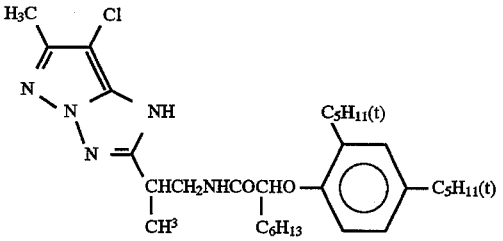

Cyan coupler ExC

A 25:75 (molar ratio) mixture of

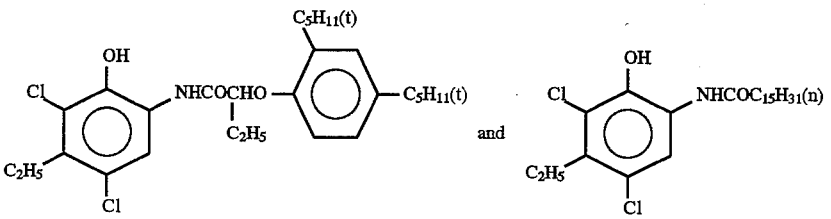

-continued
Dye image stabilizer Cpd-1
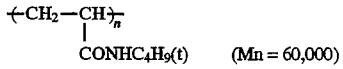
(Mn = 60,000)
Dye image stabilizer Cpd-2
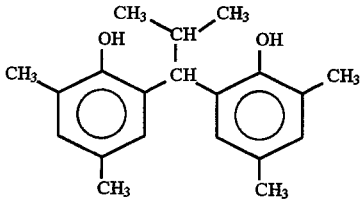
Dye image stabilizer Cpd-3
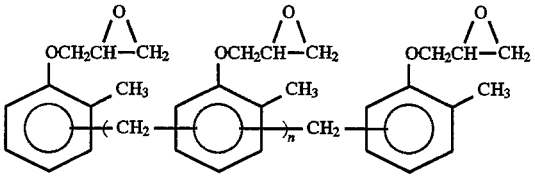
n = 7 to 8 (avg.)
Color mixture preventive Cpd-4
A 1:1:1 (by weight) mixture of (1):(2):(3)
(1)
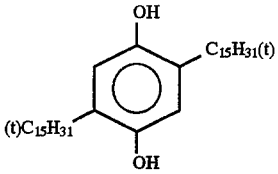
(2)
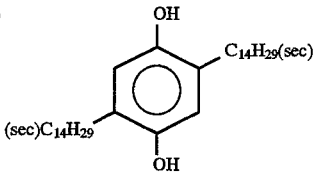
(3)
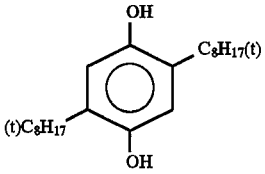
Dye image stabilizer Cpd-5
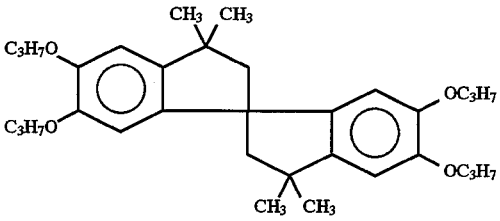
Dye image stabilizer Cpd-6
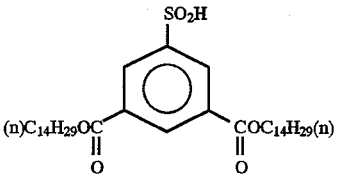
Dye image stabilizer Cpd-7
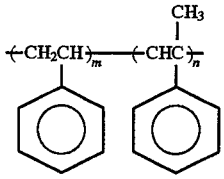
Mn = 600; m/n = 9/1
Dye image stabilizer Cpd-8
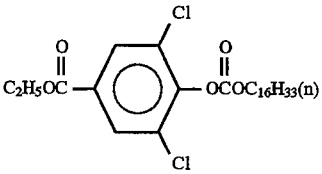
Dye image stabilizer Cpd-9
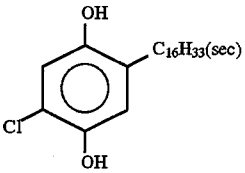
Dye image stabilizer Cpd-10
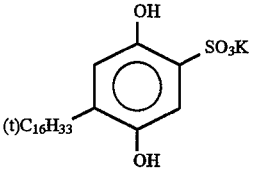

-continued
Surface active agent Cpd-11
A 7:3 (by weight) mixture of
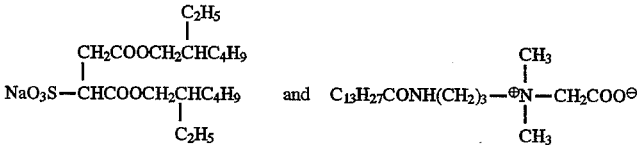
Antiseptic Cpd-12
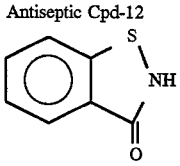
Antiseptic Cpd-13
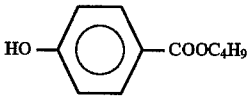
Antiseptic Cpd-14 A 1:1:1:1 mixture of a:b:c:d.
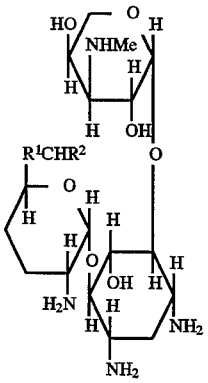
Antiseptic Cpd-15
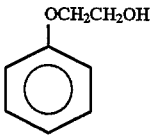
wherein
| | $R^1$ | $R^2$ |
|---|---|---|
| a | −Me | −NHMe |
| b | −Me | $-NH_2$ |
| c | −H | $-NH_2$ |
| d | −H | −NHMe |
UV absorber UV-2
A 1:2:2:3:1 (by weight) mixture of (1):(2):(3):(4):(5)
(1)
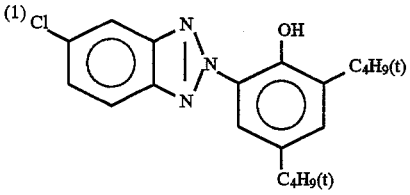
(2)
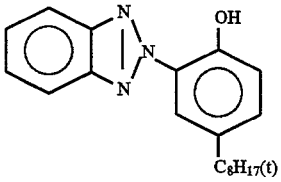
(3)
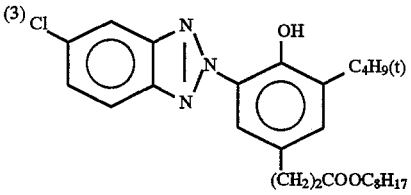
(4)
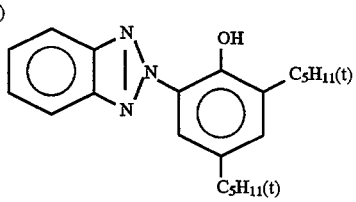
(5)
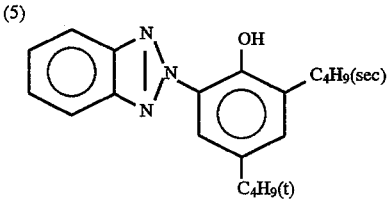

-continued

UV absorber UV-3

A 1:3:2:1 (by weight) mixture of (1):(2):(3):(4)

(1)

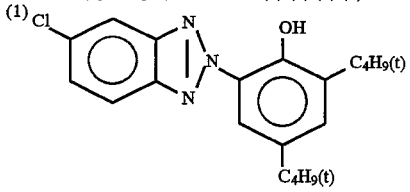

(2)

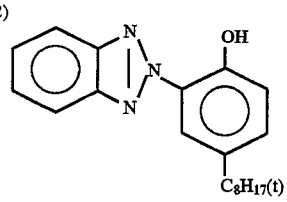

(3)

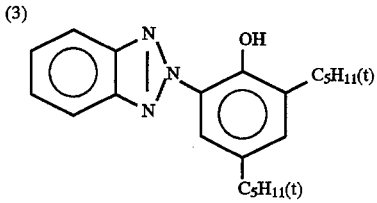

(4)

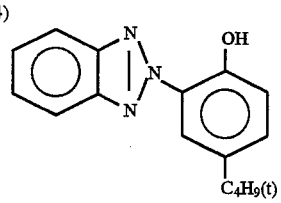

Solvent Solv-1

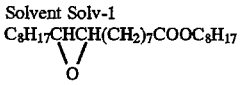

Solvent Solv-2

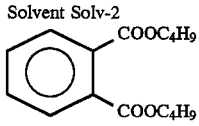

Solvent Solv-3

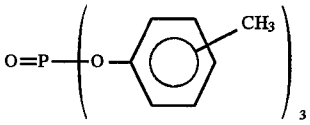

Solvent Solv-6

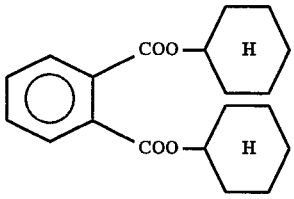

Solvent Solv-7

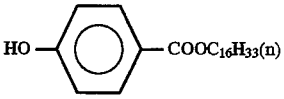

Solvent Solv-8

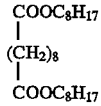

Samples 202 to 208 were prepared in the same manner as for sample 201, except for replacing the magenta coupler ExM used in the third layer with the same molar amount of the coupler shown in Table 6 below.

Each of samples 201 to 208 was wedgewise exposed by the use of a sensitometer (Model FWH, produced by Fuji Photo Film Co., Ltd.; color temperature of light source: 3200° K.) and processed as described below. The maximum magenta density D3 was measured. Further, the developed samples were preserved at 70° C. and 80% RH for 2 months, and the change in magenta density was observed. The results obtained are shown in Table 6. It is seen that the coupler according to the present invention exhibits high color developability and the dye image produced therefrom has excellent stability as compared with the comparative couplers.

TABLE 6

| Sample No. | Magenta coupler | Maximum Magenta Density D3 | Magenta Density Retention (Initial density: 1.7) (%) | Remark |
|---|---|---|---|---|
| 201 | ExM | 1.8 | 80 | Comparison |
| 202 | MC-6 | 1.7 | 85 | " |
| 203 | MC-7 | 2.0 | 70 | " |
| 204 | (M-50) | 2.1 | 90 | Invention |
| 205 | (M-52) | 2.2 | 89 | " |
| 206 | (M-53) | 2.1 | 92 | " |
| 207 | (M-59) | 2.1 | 91 | " |
| 208 | (M-60) | 2.2 | 93 | " |

Photographic Processing:

| Processing Step | Temp. (°C.) | Time (sec) |
|---|---|---|
| Color development | 38.5 | 45 |
| Blix | 35 | 45 |
| Rinsing (1) | 35 | 30 |
| Rinsing (2) | 35 | 30 |
| Rinsing (3) | 35 | 30 |
| Drying | 80 | 60 |

The processing solutions used had the following compositions.

| | Tank Solution | Reple-nisher |
|---|---|---|
| Color Developer: | | |
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Brightening agent (WHITEX 4, produced by Sumitomo Chemical Co., Ltd.) | 1.0 g | 3.0 g |
| Sodium sulfite | 0.1 g | 0.1 g |
| Disodium N,N-bis(sulfonatoethyl)-hydroxylamine | 5.0 g | 10.0 g |
| Sodium triisopropylnaphthalene-(β)sulfonate | 0.1 g | 0.1 g |
| N-Ethyl-N-(β-methanesulfonamido-ethyl)-3-methyl-4-aminoaniline sesquisulfate monohydrate | 5.0 g | 11.5 g |
| Water to make | 1000 ml | 1000 ml |
| pH (at 25° C.; adjusted with potassium hydroxide and sulfuric acid) | 10.00 | 11.00 |
| Blix Bath: | | |
| Water | 600 ml | 150 ml |
| Ammonium thiosulfite (700 g/l) | 93 ml | 230 ml |
| Ammonium sulfite | 40 g | 100 g |
| Ammonium ethylenediaminetetra-acetato ferrate | 55 g | 135 g |
| Ethylenediaminetetraacetic acid | 5 g | 12.5 g |
| Nitric acid (67%) | 30 g | 65 g |
| Water to make | 1000 ml | 1000 ml |
| pH (at 25° C., adjusted with acetic acid and aqueous ammonia) | 5.8 | 5.6 |

Rinsing Solution:

The tank solution and the replenisher had the same composition.

| | |
|---|---|
| Sodium chloroisocyanurate | 0.02 g |
| Deionized water (conductivity: not more than 5 μS/cm) | 1000 ml |
| pH | 6.5 |

According to the present invention, there is provided a silver halide color photographic material which exhibits satisfactory color developability to form a dye image having a high density and also excellent storage stability.

While the invention has been described in detail and with reference to specific examples thereof, it will be apparent to one skilled in the art that various changes and modifications can be made therein without departing from the spirit and scope thereof.

What is claimed is:

1. A silver halide color photographic material containing a 1H-pyrazolo[5,1-c]-1,2,4-triazole magenta coupler represented by formula (II):

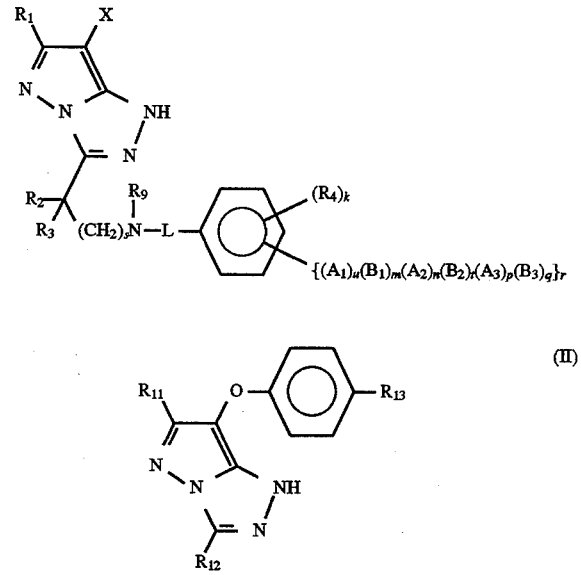

(II)

wherein $R_{11}$ represents an alkyl group, an aryl group, an alkoxy group or an aryloxy group; $R_{12}$ represents a hydrogen atom or a substituent; $R_{13}$ represents $—(W)_f—(Y)_g—Z$; W represents —O—, —NH—, $—CH_2—$ or a divalent linking group composed of two or more thereof; f represents 0 or 1; Y represents —CO— or $—SO_2—$; g represents 0 or 1; Z represents $—R_{14}$, $—OR_{14}$ or $—N(R_{15})_2$; $R_{14}$ represents an alkyl group substituted with a hydroxyl group and/or a carboxyl group; $R_{15}$ represents a hydrogen atom, a hydroxyl group, an acyl group, an arenesulfonyl group, an alkanesulfonyl group, an aryl group or an alkyl group; the two $R_{15}$ groups may be the same or different; $R_{13}$ contains 0 to 8 carbon atoms; the alkyl group represented by $R_{15}$ is a substituted or unsubstituted alkyl group when f=g=1, and in other cases it is a substituted alkyl group.

2. The silver halide color photographic material as claimed in claim 1, wherein $R_{13}$ represents $—CH_2—OH$, $—CON(R_{15})_2$, or $—SO_2N(R_{15})_2$, where $R_{15}$ represents a hydrogen atom, a hydroxyl group, an acyl group, an arenesulfonyl group, an alkanesulfonyl group, an aryl group or an alkyl group.

3. The silver halide color photographic material as claimed in claim 2, wherein $R_{12}$ represents an alkyl or aryl group substituted with a carbonamido group, a sulfonamido group or a sulfonyl group.

4. The silver halide color photographic material as claimed in claim 1, wherein $R_{12}$ represents a group represented by formula (V):

$$—C(R_{16})(R_{17})—(CH_2)_a—NHR_{18} \quad (V)$$

wherein $R_{16}$ and $R_{17}$, which may be the same or different, each represent a hydrogen atom, an alkyl group or an aryl group, or they may be taken together to form a ring; $R_{18}$ represents an alkanesulfonyl group, an arenesulfonyl group or an acyl group; and e represents 0 or an integer 1 to 5.

5. The silver halide color photographic material as claimed in claim 4, wherein e represents 0 or 1.

* * * * *